US007497534B2

(12) United States Patent
Struk et al.

(10) Patent No.: US 7,497,534 B2
(45) Date of Patent: Mar. 3, 2009

(54) ENHANCING ANGULAR POSITION INFORMATION FOR A RADIAL PRINTING SYSTEM

(75) Inventors: Robert S. Struk, Sunnyvale, CA (US); Carl E. Youngberg, Mapleton, UT (US); Jan E. Unter, Alamo, CA (US)

(73) Assignee: Elesys, Inc., Sunnyvale, CA (US)

( * ) Notice: Subject to any disclaimer, the term of this patent is extended or adjusted under 35 U.S.C. 154(b) by 192 days.

(21) Appl. No.: 10/848,537

(22) Filed: May 17, 2004

(65) Prior Publication Data

US 2004/0252142 A1 Dec. 16, 2004

Related U.S. Application Data

(63) Continuation-in-part of application No. 09/815,064, filed on Mar. 21, 2001, now Pat. No. 6,736,475.

(60) Provisional application No. 60/191,317, filed on Mar. 21, 2000.

(51) Int. Cl.
*B41J 3/00* (2006.01)

(52) U.S. Cl. ..... 347/2; 347/5; 347/9

(58) Field of Classification Search ..... 347/2, 347/5, 20; 369/47.44
See application file for complete search history.

(56) References Cited

U.S. PATENT DOCUMENTS

| | | | | |
|---|---|---|---|---|
| 4,110,594 | A | 8/1978 | May | 219/211.28 |
| 4,556,966 | A | 12/1985 | Bricot et al. | 369/52 |
| 4,721,969 | A | 1/1988 | Asano | 346/157 |
| 4,739,415 | A | 4/1988 | Toyono et al. | 358/296 |
| 5,041,846 | A | 8/1991 | Vincent et al. | 346/28 |
| 5,154,957 | A | 10/1992 | Yamada et al. | 428/64 |
| 5,317,337 | A | 5/1994 | Ewaldt | 346/1.1 |
| 5,395,181 | A | 3/1995 | Dezse et al. | 400/103 |
| 5,444,687 | A | 8/1995 | Okumura | 425/50 |
| 5,468,076 | A | 11/1995 | Hirano et al. | 400/59 |
| 5,597,590 | A | 1/1997 | Tanimoto et al. | 264/174.4 |
| 5,634,730 | A | 6/1997 | Bobry | 400/88 |
| 5,656,229 | A | 8/1997 | Tanimoto et al. | 156/400 |
| 5,717,679 | A | 2/1998 | Mashimo et al. | 369/124 |
| 5,967,676 | A | 10/1999 | Cutler et al. | 347/70 |
| 6,019,151 | A | 2/2000 | Wen et al. | 101/387 |
| 6,074,031 | A | 6/2000 | Kahle | 347/4 |
| 6,202,550 | B1 | 3/2001 | Lee et al. | 101/38.1 |
| 6,246,295 | B1 | 6/2001 | Bradshaw et al. | 331/99 |
| 6,285,726 | B1 | 9/2001 | Gotoh et al. | 375/376 |
| 6,285,762 | B1 | 9/2001 | Gotoh | |
| 6,826,136 | B1 * | 11/2004 | Jeong | 369/47.44 |
| 6,986,559 | B1 * | 1/2006 | Youngberg et al. | 347/2 |

FOREIGN PATENT DOCUMENTS

| | | |
|---|---|---|
| GB | 2320912 A | 8/1998 |
| JP | 07101039 | 4/1995 |
| JP | 09265760 | 7/1997 |
| JP | 9-306144 | 11/1997 |

* cited by examiner

*Primary Examiner*—Lam S Nguyen
(74) *Attorney, Agent, or Firm*—Weaver Austin Villeneuve & Sampson LLP

(57) ABSTRACT

Methods and apparatus for radially printing onto a rotating media are disclosed. Techniques and mechanisms are used to receive a pulse train frequency source signal in generating a rotation index pulse and an angular position pulse. Techniques and mechanisms are further used to condition the pulse train frequency source signal as necessary for the radial printing application.

30 Claims, 13 Drawing Sheets

ENHANCING ANGULAR POSITION INFORMATION FOR A RADIAL PRINTING SYSTEM

CROSS-REFERENCE TO RELATED APPLICATIONS

This application is a continuation-in-part of U.S. application Ser. No. 09/815,064, filed Mar. 21, 2001, now U.S. Pat. No. 6,736,475, which claims the benefit of U.S. Provisional Application No. 60/191,317, filed Mar. 21, 2000, wherein these references are hereby incorporated by reference in their entirety for all purposes. This application is also related to U.S. application Ser. No. 09/062,300, filed Apr. 17, 1998, now U.S. Pat. No. 6,264,295, which is also incorporated herein by reference in its entirety for all purposes.

BACKGROUND

The present invention relates to printing systems and methods for printing with the same. More particularly, the present invention relates to printing systems with ink jet cartridges that are configured to radially print directly on to the top surface of a circular media that is inserted into a CD drive mechanism, while the CD drive mechanism rotates the media in relation to a printing assembly.

In the art of dispensing fluidic ink objects as it applies to radial printing, there is a need to place ink objects accurately and precisely onto the spinning circular media to effectively use the mechanisms of radial printing. In a radial printing application, ink is placed onto a circular media as it is rotating. To properly place the ink, the mechanisms governing the print process must have as one of its inputs information relating to the instantaneous position of the disk with respect to the print engine emitting the ink. That information over a period of time translates to instantaneous angular position and velocity, which affects other aspects of radial printing such as pen firing frequency. Thus, in any radial printing system, a mechanism must be employed to provide the electronics governing the printing process with the information regarding the instantaneous position of the rotating media or disk.

Accordingly, there is a need for mechanisms for providing an instantaneous angular position of a rotating media for use in printing onto such rotating media.

SUMMARY

The present invention relates to information circular recording media, such as an optical disc like CD recordable media (CD-R). For the scope of the present invention, the terms "CD" and "media" are intended to mean all varieties of optical recording devices that record media and their respective media discs, such as CD-R, CD-RW, DVD-R, DVD+R, DVD-RAM, DVD-RW, DVD+RW and the like. More particularly, this invention uses a variety of methods to determine the instantaneous angular position of a spinning and typically circular recordable CD-R media to enable radial printing. This includes: using prerecorded timing information from the native wobble signal in pre-grooved CD-R recordable disc media over the entire prerecorded disc area; using the timing-code information in the data track of an already recorded CD-R disc; using signals from the rotating spindle motor, such as the motor poles and associated Hall Effect sensors; using an encoding pattern from a code wheel on the shaft of the rotating spindle motor; or using an entirely independent encoding pattern pre-placed during manufacturing directly on the inner hub or outer circumference edge of the CD-R media coupled with an external encoder sensor. These signals are uniquely combined with a radial printing system to form a synchronized system for printing a label on the top surface of the recordable disc media while the disc is spinning, independent of recording, during recording or during playback.

The CD Standard Specifications Orange Book specifies in detail how CD-R media are to be pre-grooved for use, which is well known to those skilled in the art. Timing markings along a pre-grooved spiral track contains a wobble signal. This wobble signal provides CD laser head servo tracking alignment and clocking information to control disc spin rate. The native wobble is present throughout the prerecorded CD-R disc media, including the prerecorded track in the Power Calibration Area (PCA) 320, the Program Memory Area (PMA) 330, lead-in 332, data programming 334, or lead out 336 areas. Alternately this invention uses the timing-code information in the post-recorded data area of the CD-R media.

The present invention uses several methods for sensing the angular position of rotating or spinning CD-R media to be utilized in a radial printing system. FIG. 2 is a diagrammatic representation of an example radial printing system in which the present invention may be implemented. As shown, the printing head assembly 210 is placed radially over the spinning CD disc 214. The synchronization system 204 uses signals from the CD servo 206 to sense the disc 220 (platter 201) spin rate or control the motor 208. Several embodiments of a radial printing system are described above in the U.S. Pat. No. 6,264,295 (Bradshaw et al), which is incorporated by reference. Radial printing can be optionally performed on spinning media, even while actual CD recording is in process. As such, a radial printing system preferably determines the instantaneous angular velocity and position of rotating CD-R media to enable radial printing.

In another embodiment, the present invention uses several methods to further condition, extrapolate and otherwise process the utility of angular position event sources, which are marginal, to enhance their suitability for radial printing. For example, in one exemplary configuration of the present invention, a phase lock loop (PLL) is used to stabilize and multiply the angular position event source generated from either a spindle motor pole Hall Effects sensors or an encoder reading a low-count codewheel. In another exemplary configuration of the present invention, several variations of a synthesized multiplier method are used to digitally enhance, synthesize or otherwise extrapolate angular position event sources suitable for radial printing.

The present invention makes use of these signals either directly on CD-R media, from the rotation spindle motor, or from an encoder coupled to the rotation spindle motor shaft, in unique methods to provide angular position information for radially printing a label on the top surface of the CD-R media while it spins.

These and other features and advantages of the invention will be presented in more detail below with reference to the associated drawings.

BRIEF DESCRIPTION OF THE DRAWINGS

The invention, together with further advantages thereof, may best be understood by reference to the following description taken in conjunction with the accompanying drawings.

DETAILED DESCRIPTION

The present invention will now be described in detail with reference to a preferred embodiment thereof as illustrated in the accompanying drawings. In the following description, specific details are set forth in order to provide a thorough understanding of the present invention. It will be apparent, however, to one skilled in the art, that the present invention may be practiced without using some of the implementation details set forth herein. It should also be understood that well known operations have not been described in detail in order to not unnecessarily obscure the present invention.

To determine the instantaneous angular velocity and rate of disc spin specifically for radial printing, the radial printing system synchronizes with the spinning disc media or the CD-R device control system. To do this, this invention uses signals from among the following: (1) the inherent pre-grooved wobble frequency signal in the unrecorded track of a new CD-R disc as read from the laser read head of a CD drive mechanism, (2) the timing-code information in the data track of an already recorded CD-R disc as read from the laser read head of a CD drive mechanism, (3) an entirely independent encoding pattern pre-placed during manufacturing directly on the inner hub or outer circumference edge of the CD-R media, or post-placed by recording (burning) a timing pattern onto the media by the drive and reading it back for print timing purposes; (4) the signals from the rotating spindle motor, such as the motor poles, or (5) an encoding pattern from a code wheel coupled to the shaft of the rotating spindle motor with an external encoder sensor.

Figure 1:
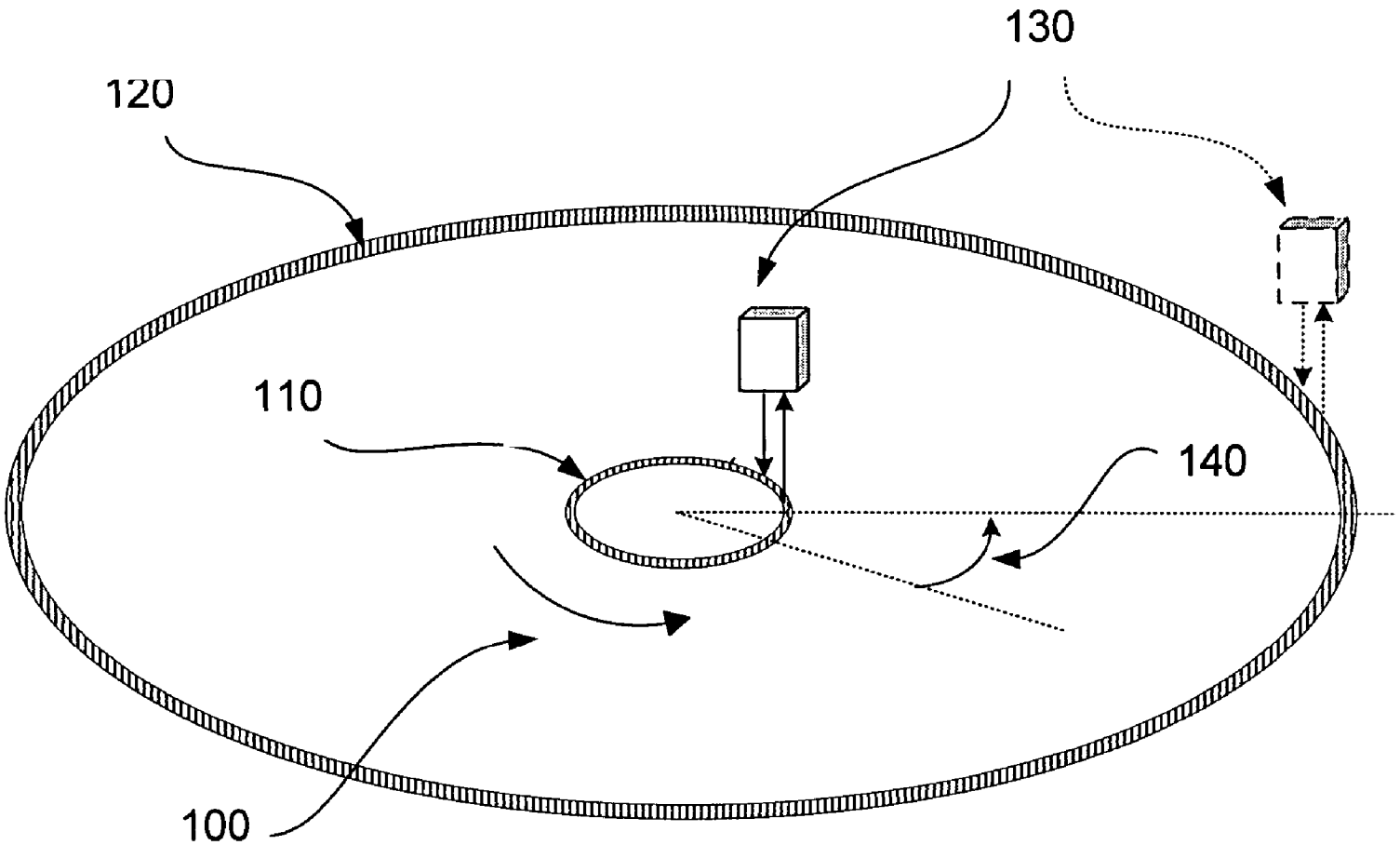
FIG. 1 is a diagrammatic representation of a CD-R recordable media.
Figure 2:
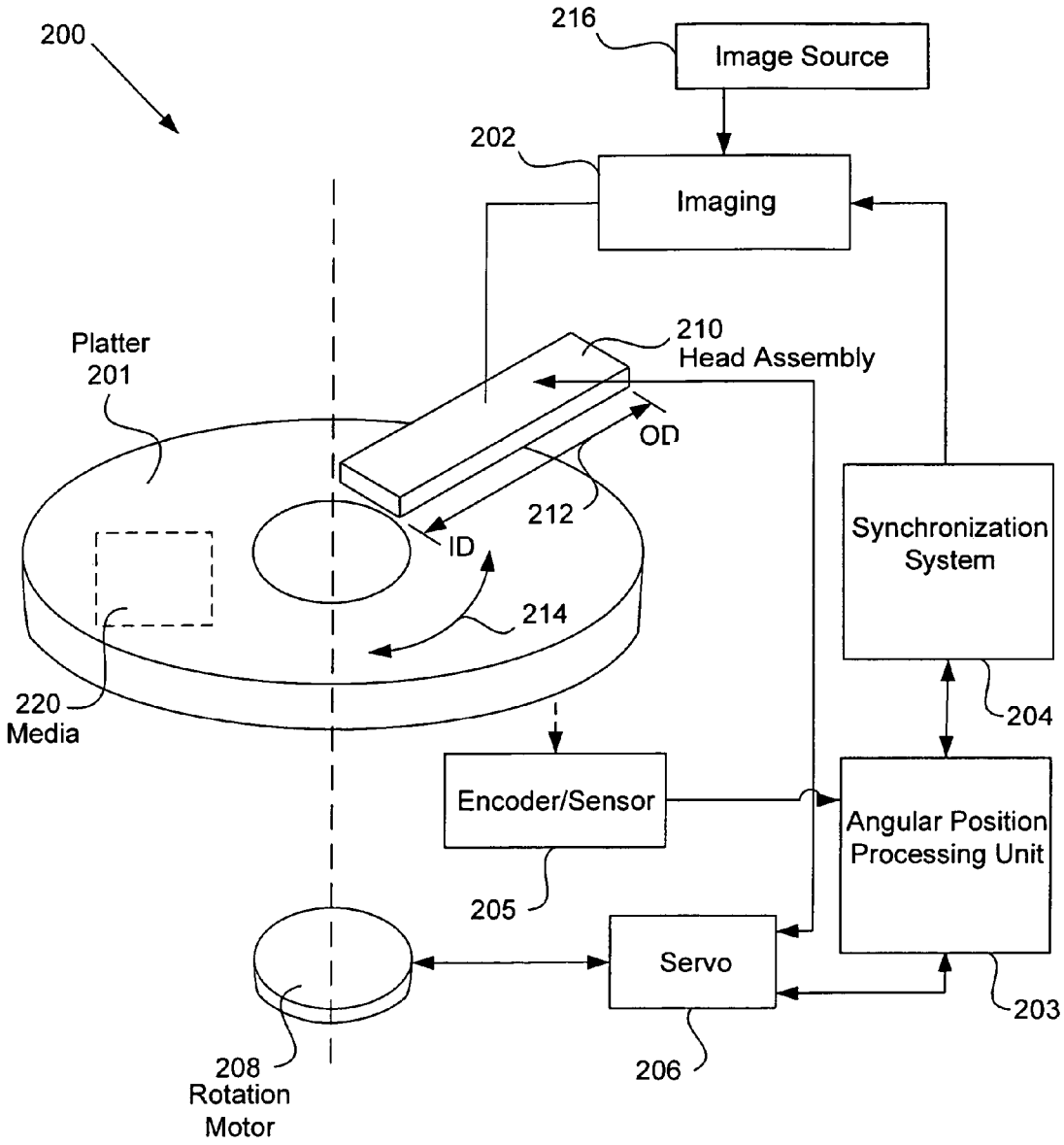
FIG. 2 is a diagrammatic representation of an example radial printing system in which the present invention may be implemented.
Figure 3:
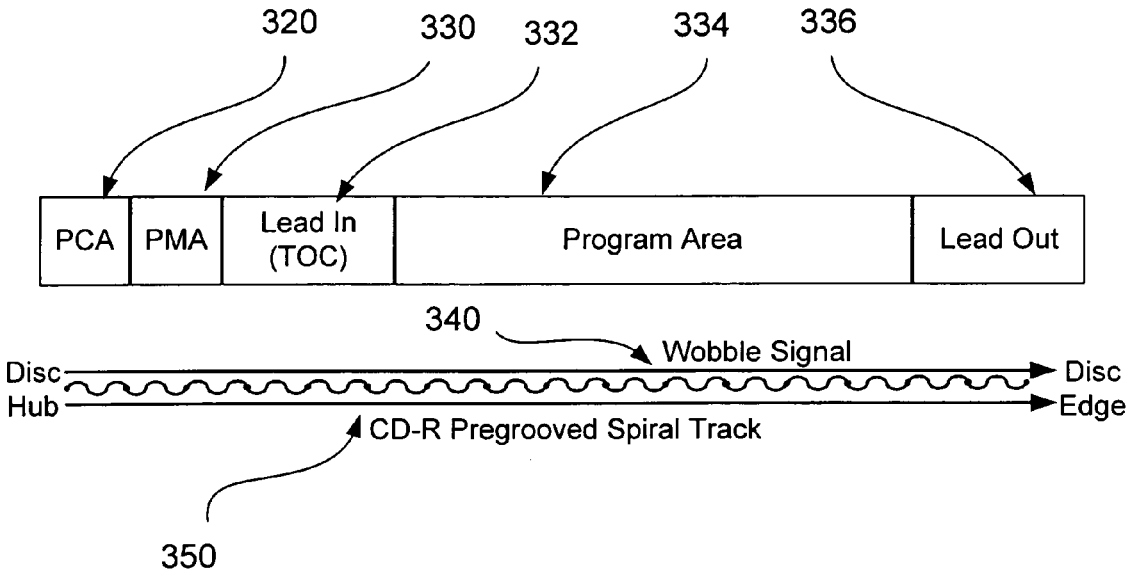
FIG. 3 illustrates a pre-groove spiral track wobble frequency signal inherent in all CD-R recordable media, which wobble signal may be used to determine the instantaneous angular position of such CD-R recordable media in accordance with a first embodiment of the present invention.
Figure 6:
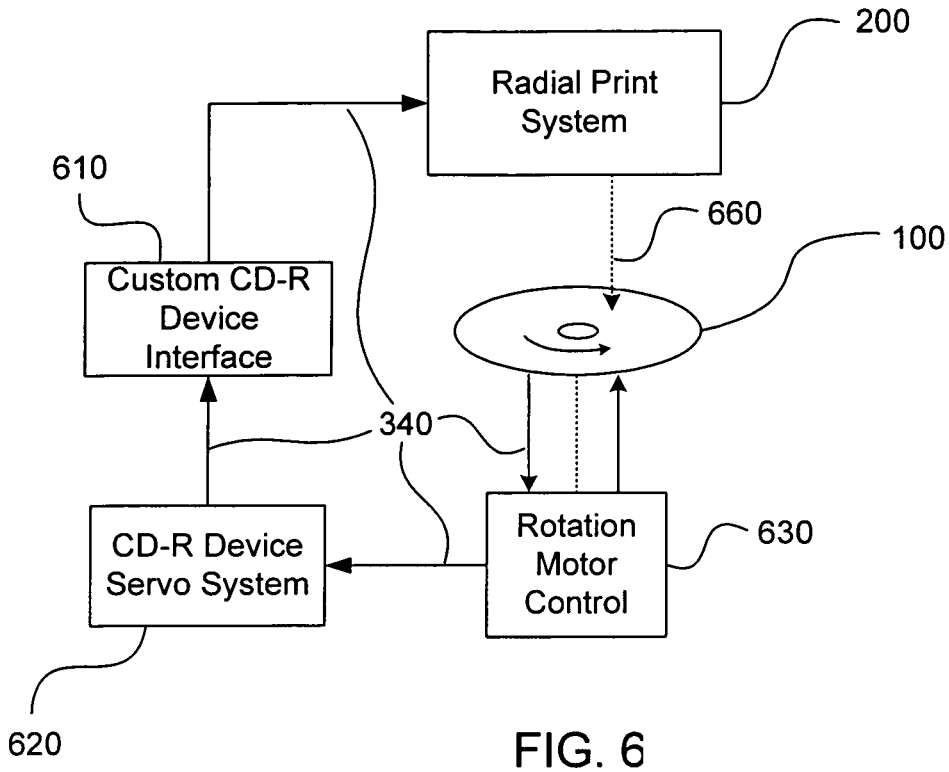
FIG. 6 is a diagrammatic illustration of a CD-R/printing system which utilizes the wobble signal or a derivation of the wobble signal to print onto a spinning media in accordance with an example implementation of the first embodiment of the present invention.

An embodiment of the present invention may use the pre-groove spiral track 350 wobble frequency signal 340 illustrated in FIG. 3 inherent in all CD-R recordable media to determine the instantaneous angular position 140 of a spinning circular media 100 shown in FIG. 1, to enable precise placement of ink in the application of radial printing shown in FIG. 2, such as with an ink jet print head 210. While this signal 340 is used primarily for alignment and tracking of the CD-R laser for reading and recording shown in FIG. 6, 620, it can also be used to determine the angular position 140 (FIG. 1) of the spinning media at any given time during rotation and thus provide a high degree of printing accuracy. Since these timing signals are only available while the CD-R media is spinning, preferably they are carefully synchronized with the CD writer device control system. For example, the CD-R recording software is preferably tightly coupled and synchronized with the software that controls the printing to ensure that the printing process proceeds without interfering with the recording process. Likewise, since the CD motor 630 must be spun an adequate number of revolutions to complete the printing process, it may be necessary to activate the CD-R motor 630 to finish the printing task.

The advantage of this method is to provide accurate angular print information without the need for additional components, such as an external encoder and code wheel, since it uses standard CD-R media for all timing information. For example, an all-in-one device to record discs and print labels on encoder-pattern-grating CD/DVD media may be designed for lower overall manufacturing cost or may allow a smaller size of the device, because an external encoder or grating is unnecessary.

Figure 4:
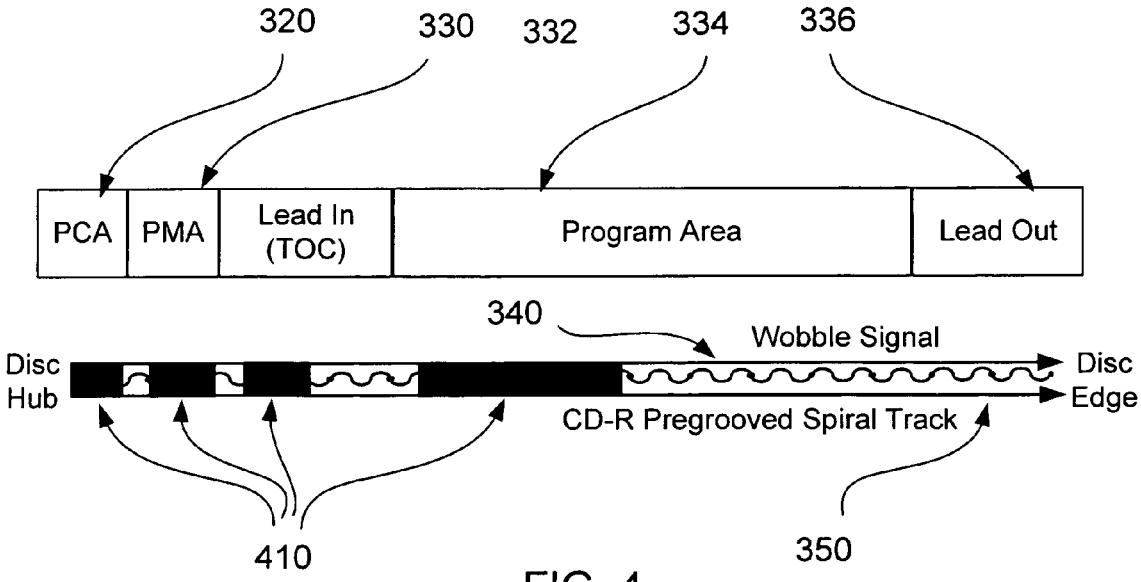
FIG. 4 illustrates the wobble frequency signal and the timing code information inherent within the data track of a partially or fully recorded CD-R recordable media, which signals may be used together or separately to determine the instantaneous angular position of such CD-R recordable media in accordance with a second embodiment of the present invention.

In another embodiment of the present invention, similar to that already described, the same considerations are necessary for printing on CD-R media; however, the disc media may contain partially completed recording information. This is illustrated in FIG. 4 in contrast to FIG. 3. In FIG. 4, the timing signals used to determine the angular position 140 of the spinning media 100 are derived instead from or a combination of the timing-code information in the data track 410 of an already- or partially recorded CD-R disc. In the later case of a partially recorded disc, such as a Multi-session disc, the timing information 410 is derived by combining timing-code information in the data track of the already recorded area, on the one hand, with the pre-groove wobble frequency signal 340 inherent in remaining unrecorded media, on the other hand; these are used in concert to determine the instantaneous angular position 140 of a spinning circular media 100.

Data Pattern Spiraling Angular Position and Mark

Figure 10:
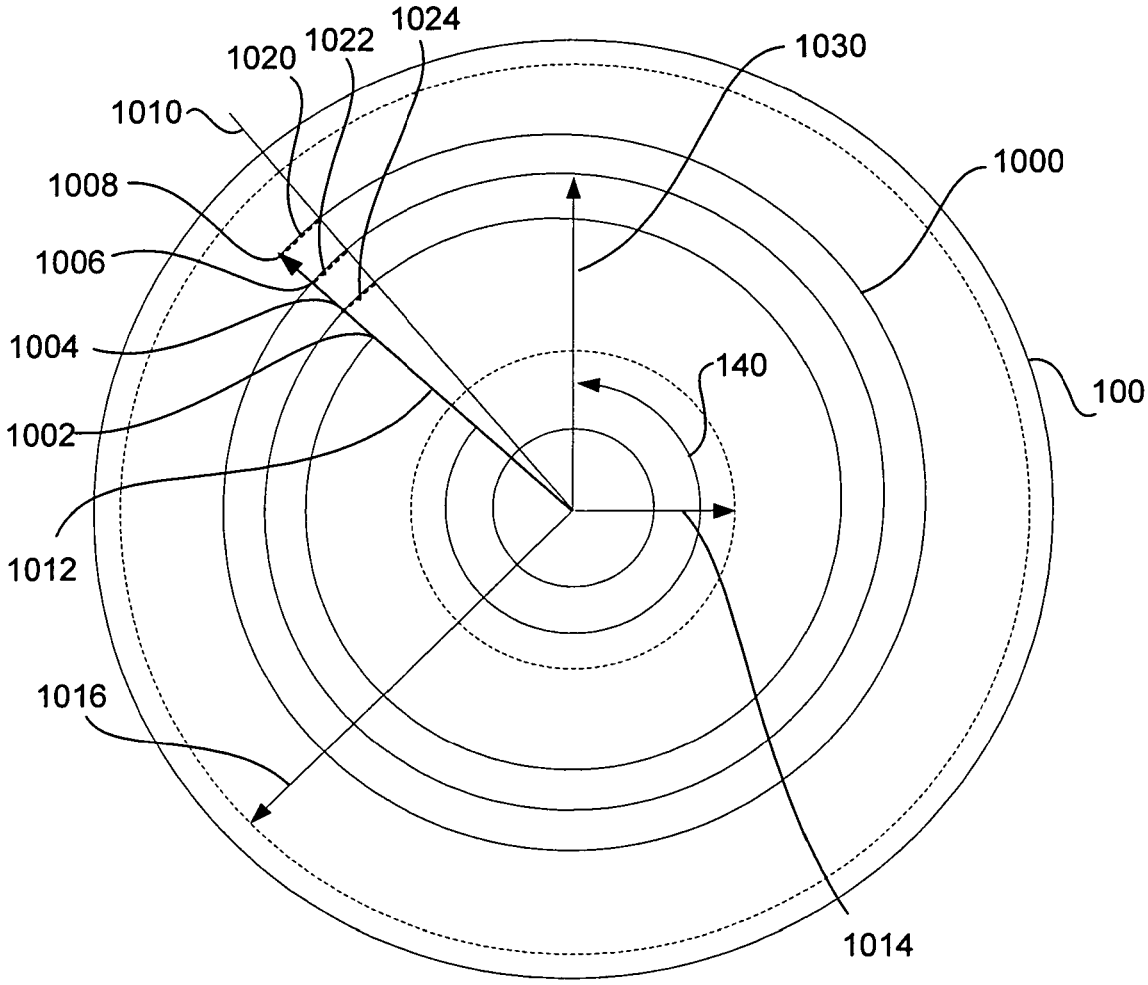
FIG. 10 is a diagrammatic representation of the wobble or data tracking for the CD laser read-write head in spiral fashion according to various embodiments of the present invention.

In another embodiment of the present invention, a radial printing device comprising of a CD drive as the spinning component may be configured with firmware to cause special data patterns to be written and read from the disc 100 in a form of instantaneous angular position information 140. FIG. 10 is a diagrammatically representation of the wobble or data tracking for the CD laser read-write head in spiral fashion. A angular position track 1000 in the form of a pattern of encoded or unencoded data may be written into the data or the PMA areas of the media disc, such that a pattern or encoded stream with a known data pattern may be repeatedly read back to provide angular position information 140, to be later interpreted or decoded as the angular position 140 for printing. Once per revolution at a specific annular position 1010, a special data field or blank data is written to create a mark 1020 as the completion of a revolution 1010. During operation, while initially writing the data pattern regularly through the duration and length of the spiral path, the CD laser tracking head follows this spiral angular position track 1000 by using the wobble-tracking servo-subsystem; similarly while reading the pattern back the CD laser tracking head follows this spiral angular position track 1000 by using the spiral-tracking servo-subsystem to follow the data pathway. The CD disc spiral angular position track 1000 may begin at an inner radius 1014 of the CD and may track to an outer radius 1016. A method may be used to write the data onto the media's 100 data area 1014~1016 in a pattern that is clearly recognizable, leaving a portion with a blank gap or some other unique sequence or pattern of data to create a digital rotation mark 1020 at any plurality of annularly position 1020~1024, once each revolution at angle 1010. Any pattern may be used, such as binary sequences as 101010 . . . or 111000111000 . . . and so on, depending on the drive system's responsiveness to interpreting the results. In the present example, the "ones" may represent angular position information 140 and the zeros may not. Other patterns or interpretations may be alternatively used. Since this data may be written to a angular position track 1000 comprising an outwardly increasing spiral (see 1000), at a know radius 1012, the blank gap or mark 1020 may be calculated using well known mathematics for a spiral for any given radius 1030. Once written at a radius 1012, the drive system may be configured to read the data back continuously, interpreting the data stream as angular position information 140 at the respective angular position and the blank gap 1020 of the data stream as the mark 1020 per revolution. When the mark 1020 is recognized, laser head physically moves from track position 1006 to track position 1006, in one embodiment, to resume repeatedly reading the data track for angular position information 140. In an alternative embodiment that may use a longer duration of angular position track 1000 information to determine angular position information, the data may be written a plurality of rotations with marks 1020~1024 once at the start of each rotation 1002~1006, then read back a plurality of times decoding the data stream as the angular position information 140 and the blank gap as the rotation or index mark 1020~1024, before restarting at the beginning of the first data track 1002; this may be adjusted suitably to allow adequate time for the physical laser head's tracking servo system to respond to one or a plurality of tracks needed to reset from the outer track position 1008 to the first track position 1002; the process is repeated while spinning the spindle motor until radial printing has completed. Similar to the embodiments previously described, the advantage of this method is to provide accurate angular print information without the need for additional components since it uses standard CD-R media for all timing information.

Figure 5:
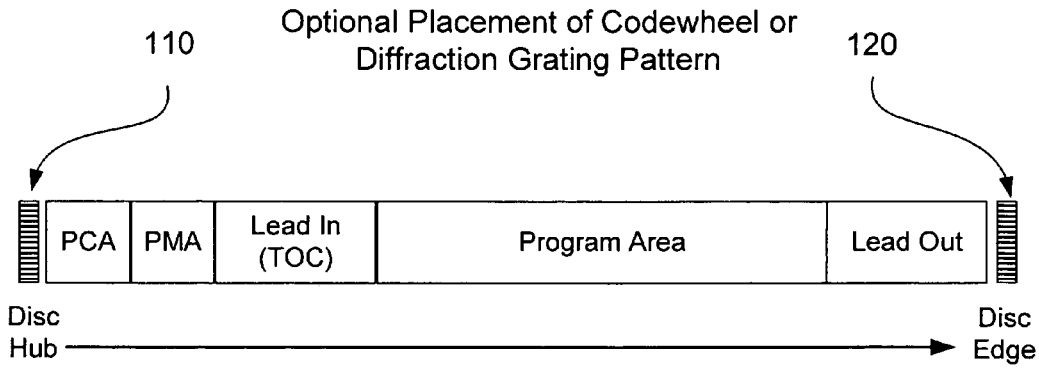
FIG. 5 illustrates placement of an encoder pattern or grating onto a CD-R recordable media, which encoder pattern or grating may be used to determine the instantaneous angular position of such CD-R recordable media in accordance with a third embodiment of the present invention.
Figure 7:
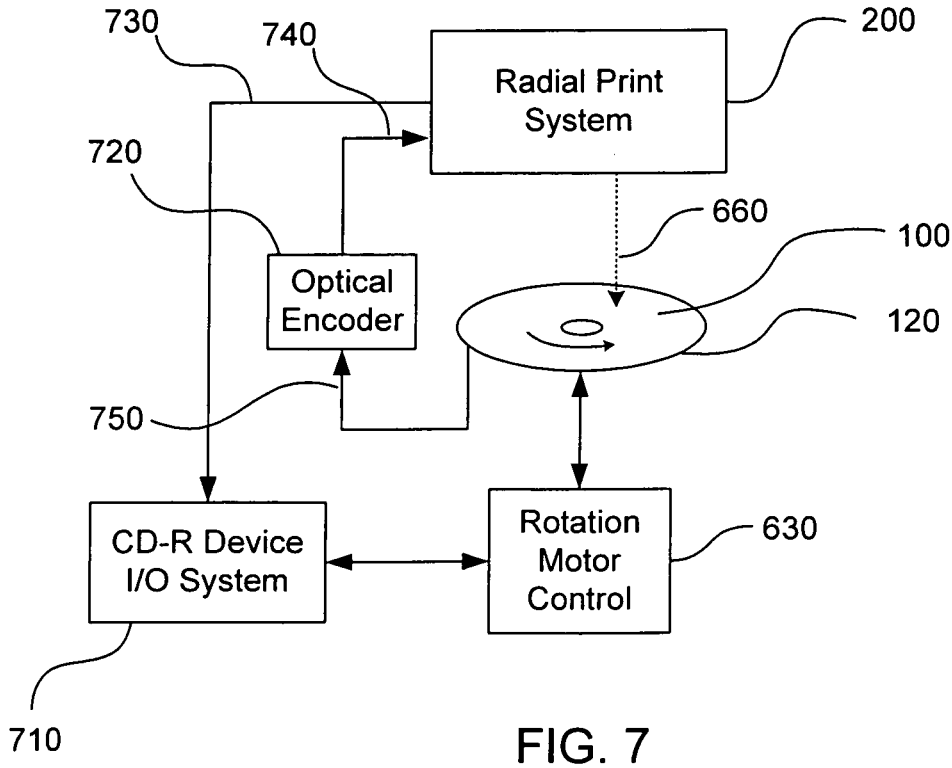
FIG. 7 is a diagrammatic illustration of a CD-R/printing system that utilizes a custom encoder pattern or grating on the CD-R recordable media to print onto such media in accordance with an example implementation of the third embodiment of the present invention.

In yet another embodiment of the present invention, illustrated in FIG. 1 and in the block diagram in FIG. 7, the recordable CD media is manufactured with a unique design to include an explicit encoder pattern or grating directly on the inner hub 110 or outer 120 circumference edge of the media, similar to the functions of a traditional encoder wheel. The grating pattern 110 or 120 is positioned just prior to or after the preformatted CD-R data area as shown in FIG. 5 herein. In the application for a radial printing system (FIG. 2), an encoder sensor 130 is positioned over the respective inner 110 or outer 120 track to count and measure the angular position. Given adequate angular resolution 140, this information is used to precisely place printed material 660 onto the spinning disc media 100, independent of the disc spin rate. This method has the advantage of providing encoder positional information without the need for a separate, external encoder wheel or grating pattern, since it is already included in the CD-R media during manufacturing. It also has the advantage of providing necessary angular print information completely independent of and decoupled from the normal operations of the CD recording system. Since it automatically and independently senses or detects the spin rate from the signal 750 and 740, the radial printing system only needs to command the CD motor 630 to spin an adequate number of revolutions to complete printing, should the CD recording or reading process complete prior to completing radial printing. This simplifies the device, since the CD motor 630 can be enabled through its standard interface 730 via software control rather than a custom hardware interface 610. Illustrations in FIG. 1, FIG. 5, and FIG. 7 show the potential locations for the encoder pattern according to this method, near either the inner hub or outer circumference, either on the bottom side or on the top side of the media. However, other placements, methods and embodiments for encoder patterns directly on CD-R media may be devised as the technology and evolving CD or circular media standards permit.

A zero synchronization or index mark widely known to and used by those skilled in the art is included in the encoder pattern 110/120 to reset the count with each rotation. A benefit of this new method is that it re-synchronizes the label position on a CD-RW media when re-inserted. This method enables removing and later reinserting the media multiple times to include additional printed content to the top surface of the media, or in the case of rewritable media (CD-RW/DVD-RW) this would allow adding new printed label information as new data is rewritten to the media, without the need for recognizing a previously printed label pattern. For example, one application is adding new picture files to previously recorded CD-RW (rewritable) media; the original disc label was prepared and saved as a template; upon reinsertion, the user updates the label template adding extra label or identification to the CD and then prints it again with prefect registration. In summary, this embodiment of the present invention shows how to include an optical or diffraction grating pattern directly on blank circular media, negating the need to add an external encoder grating pattern and enabling the new technology to be able to re-synchronize the label position on a CD when re-inserted.

The Nature of Signals Used, Created, Calculated or Derived

The nature of signals used, created, calculated or derived for radial print purposes is discussed: Correct pen firing signals are needed for the accurate registration of ink droplets. This timing information (for correct pen firing) is dependent on the instantaneous position of the CD/DVD disc (or spindle motor which drives it). Knowledge of the disc position, or its first derivative which is speed of rotation, and or its second derivative which is acceleration (or deceleration) is necessary and sufficient to provide this timing information.

Any or all measurement techniques and methodologies which measure, detect or determine any or all of disc position, rotational speed or acceleration are claimed as various embodiments for the purposes of radial printing. Some examples of such timing signal sources are: a) native signals from the disc drive itself; b) external transducers and sensors such as optical gratings and encoders, strobes etc; c) required timing information contained as signals written on the disc itself and decoded.

If measuring speed or acceleration, then the constants of integration (to obtain position or speed as the case may be) can be termed either 'fixed' or 'relative' and are respectively 'fixed systems' and 'relative systems'. Both are determinate. If, by way of example, we are measuring disc rotation speed, and the constant of integration is 'fixed', for example by affixing a specific physical timing mark (reference or index mark) on the circumference of the rotating mechanism or platter, then when detected, that specific location is always 'fixed'. This mark, together with the speed information allows you to know absolute position everywhere, and allows for features such as being able to stop the disc, start it again and continue printing where you left off. (since this reference mark is both fixed and determinate)

If this fixed mark 910 is positioned on the CD/DVD 100 itself, then in this fixed system, the disc could be removed from the mechanism, and put back in a new position on the platter. However, because of the affixed physical mark, when detected, absolute position is again known everywhere exactly as before removal from the spindle mechanism and printing could be resumed where it left off.

The constant of integration may also be 'relative', meaning that an absolute positional or physical mark doesn't exist. In such a relative system, no external index or reference information exists. In this case, a reference or index mark is created, derived or calculated and is selected by the electronics (hardware and or software) from rotational speed dependent signals, and is arbitrary for a particular printing session. Rotary period index pulses 818 and encoder pulse output 912 are examples of several possible rotational speed dependent signals that may be produced and obtained from several sources such as the cd drive 810 or from external encoding means 130. This reference or index mark represents an arbitrary but determinate and real position on the rotating disc. In such an embodiment, positional information is again, accurately known relative to the arbitrary index mark while the disc is rotating, and is sufficient for printing and completing the disc. All other angular positions signals such as 818, 912 and others as per alternate embodiments are known and determinate having a fixed and or well defined relationship with respect to this index mark 862, 914 by way of example. If however printing is interrupted and the disc is stopped, then the arbitrary mark is lost and so is the associated positional information. As such, printing could not be resumed continuing from 'where it was left off'.

Figure 8:
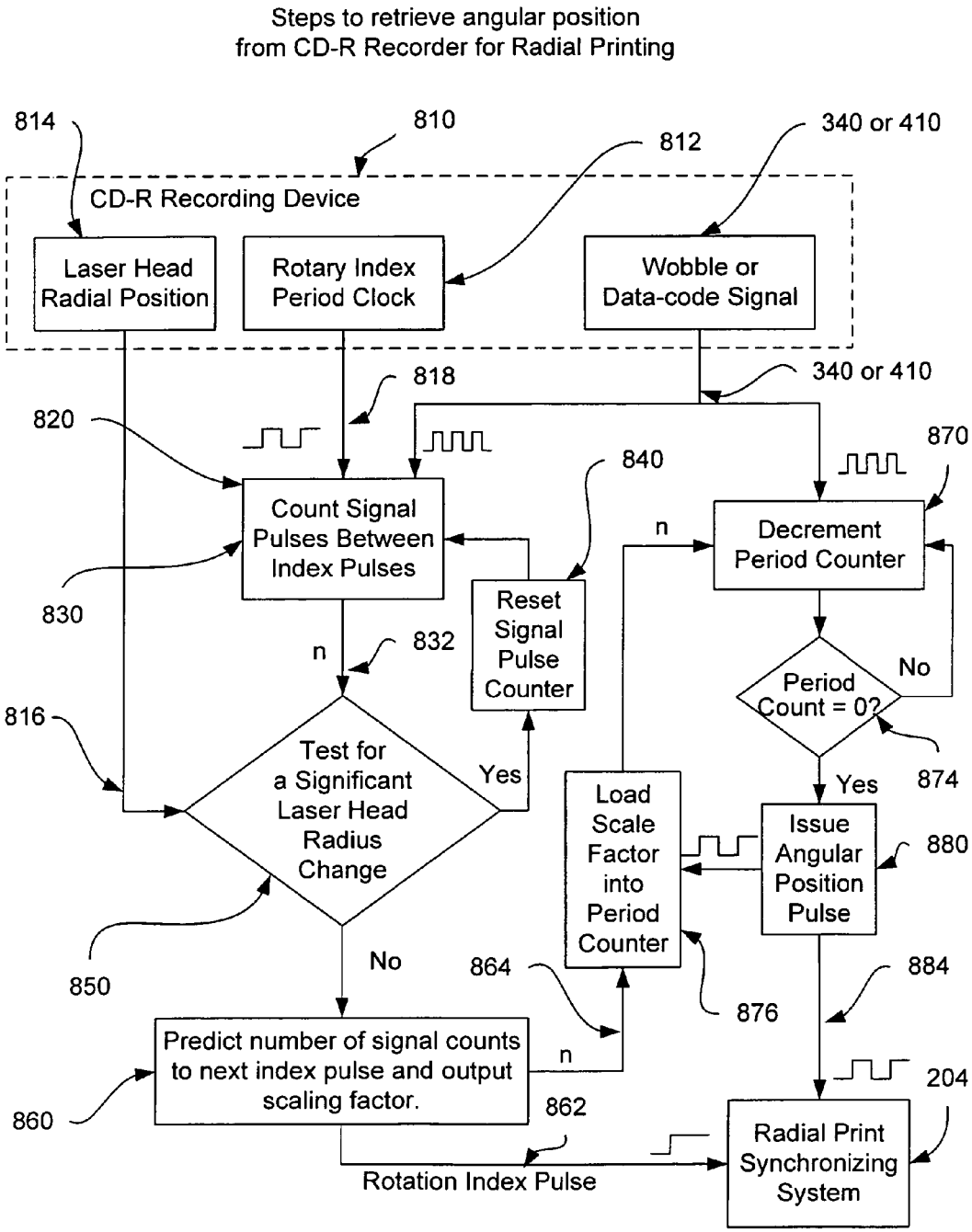
FIG. 8 is a flowchart illustrating a procedure for using the wobble or data-code signal from the CD-R recording device to print onto a rotating media in accordance with the first and second embodiments of the present invention.

By way of further example, the angular position 140 may be derived from normal signals present within a CD-R recording system. Referring to FIG. 8, three types of signal sources are identified 810 which provide signals carrying sufficient information with an adequate accuracy and precision to determine angular position 884 and rotation index position 862 and thus enable radial printing: the wobble 340 or data-code 410 signals, the laser head radial position 816, and a rotary index period clock pulse 818. These signals or others containing disc rotation speed and or position information or other timing signals may be used either singly or in combination to enable radial printing. The latter, rotary index period clock pulse, can be generated in several ways, such as: a signal on the CD-R drive control system, the CD-R spindle motor pole positions (usually from Hall Effects sensors), and external reference clock (separate component), or an external optical sensor determining the CD rotation (separate component). We anticipate other methods to acquire or fashion this rotary index period clock pulse; however, in general, this signal must be present to modulate the wobble or data-code signal or may be originally used as the basis for extrapolating the count, such as with the motor pole signals.

In FIG. 8, the rotary index period pulses 818 are periodic pulses which occur one or more times per revolution depending on the drive system and at irregular positions. For a given CD-R drive type however, the rotary index period pulses 818 will be at or define fixed and repeatable angular positions 140 while the disc is rotating. Typically, these pulses 818 may be obtained from the drive's 810 spindle motor assembly's control and or Hall Effect sensor signals. These signals 818 are speed dependent. The signals 818 are structured having fixed angular displacements which are independent of speed. There are a fixed, specific number of them per rotation. The rotation index pulse 862 is a periodic pulse occurring once per rotation. It may be produced by a CD recording device 810, by other external means or it may be derived or calculated from the rotary index period pulses 818 in such a way that only one pulse per revolution occurs. For example, we consider the case where it is desired to derive or calculate the rotation index pulse 862 from the rotary index period pulses 818. Noting the fact that rotary index period pulses 818 are structured, well defined and repeatable for each rotation of the disc, any one of these pulses may be selected to be the rotation index pulse 862. Where a specific drive type spindle motor may produce 18 pulses per rotation 818 for example, a single pulse per rotation may be calculated by counting these 18 pulses and dividing by 18, or similarly it may be derived by using a 'divide by N' counter or its functional equivalent where N is programmed to be 18. In general, where the source signal 818 produces a well defined specific number M pulses per rotation, then counting and or dividing by M will produce one pulse per rotation which is the rotation index pulse 862. As discussed on page 14 we see that in the case of the above example, signals 818 and 862 are termed 'relative' belonging to a 'relative system'.

There are other ways the reference angular position may be derived, calculated or formulated from the rotary index signal (e.g., rotary index pulses 818) and or other timing information (e.g., wobble 340 or data-code 410 signals) since there is a fixed relationship between the reference angular position, the rotary index pulses and the pulses 340/410 of the timing information that collectively occur within one revolution of the rotating media. As such, reference angular position can be dependent on the timing information. For instance, as per FIG. 8, there could be (n) signal pulses 340/410 for each rotary index pulse 818 and (m) rotary index pulses 818 for one reference angular position (e.g., rotation index pulse 862). Therefore a reference angular position of the rotating media can be calculated by adding together (m) the number of rotary index pulses 818, multiplying (n) signal pulses 340/410 with (m) index pulses 818, or by adding together the number of signal pulses 340/410 per rotation. Using a counter to divide by this product (nm) or sum as the case may be, yields one pulse per rotation e.g. a reference angular position. Accordingly, the reference signal can be synthesized (e.g. using the timing information present within the rotating media, the rotary index signal etc.). Such a synthesized reference signal is an example of a relative system. Other angular position is dependent on timing information as well. For example, in FIG. 8, signal 818 defines fixed angular displacements, which may be interpolated by timing signals 340/410, in order to produce other required angular positions 884.

Similarly, other angular positions may be synthesized and determined. The source signals (positional 818, timing 340/410 etc) as discussed, provides knowledge as to the total number of pulses (interpolated or not) for a rotation. Counting these pulses, referenced to the rotation index pulse 862 for example, determines any angular position on the disc with resolution limited by the total number of pulses within a rotation. Other calculations may be made such as considering the difference between counts (e.g. their corresponding angular positions) which defines other angular displacements. Various angular displacements and their corresponding angular positions and or their angular position pulses 884 are required as are determined by specific radial print mechanism designs.

FIG. 8 is an example of a method of how to synthesize a required number of angular position pulses 880 per rotation. The signal pulse counter 820 uses either the data-code signal pulses 410, or the wobble pulses 340, to determine the number of signal pulses 340/410 between the rotary index period pulses 818. Given the fixed relationship between angular position 140 of rotary index period pulses 818 and the current signal pulse count 340/410, a prediction is made for the number of signal pulses 340/410 that will occur per angular position 140 in the next region between index pulses. The prediction is converted into a scale factor 864 by dividing it by the number of angular positions per index region, based upon the geometry of the angular position 140.

The number of signal pulses 340/410 between rotary index period pulses cannot change significantly in order to accurately predict the scale factor 864. However, if the laser radial position 816 is repositioned differently from the current helical writing or reading track 350 by the CD-R system, a more gross correction is required to generate accurate angular position 140 for the radial printing system. In this case, the signal pulse counter 840 must be recalibrated by clearing and recounting until the count 832 is stable.

Figure 9:
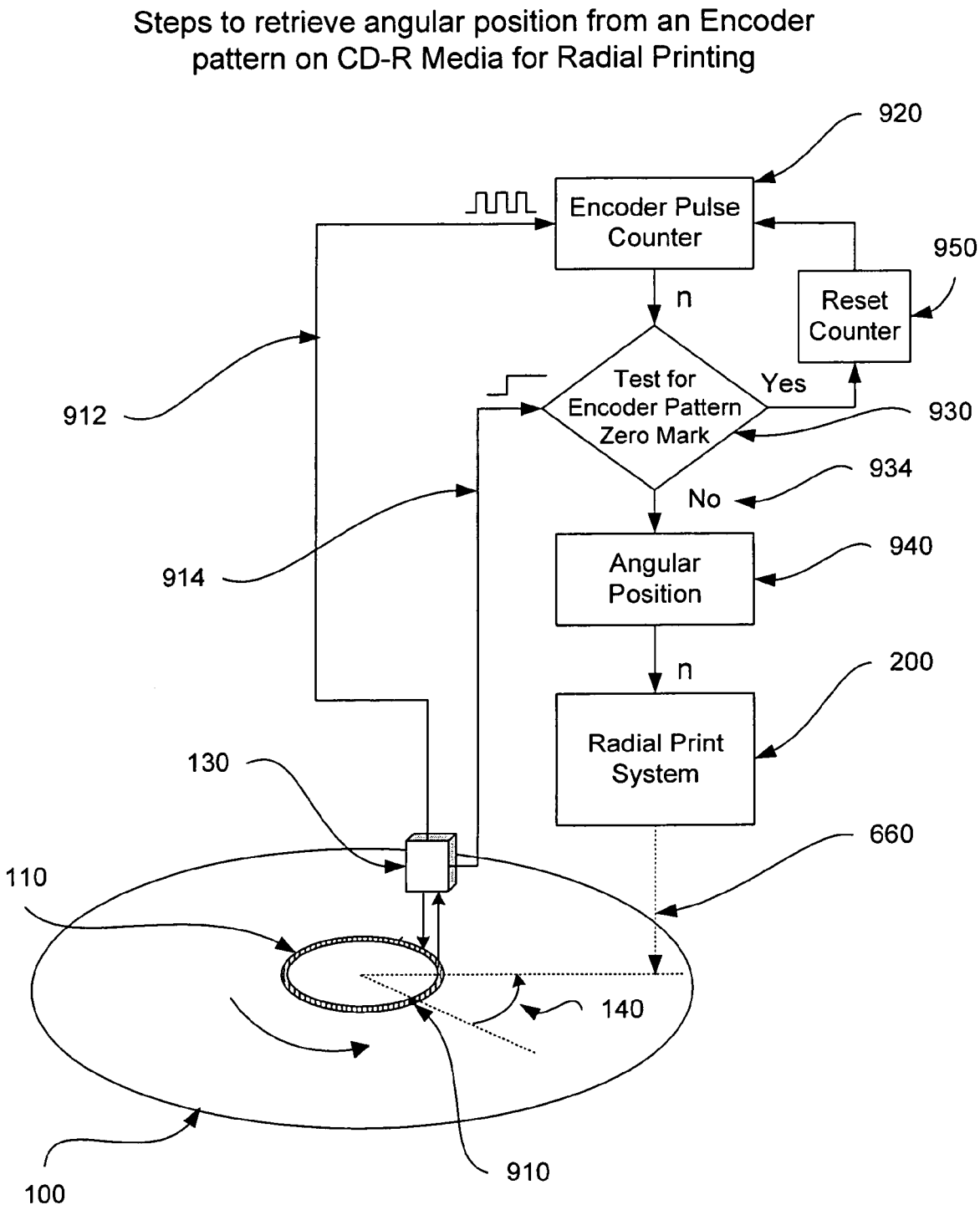
FIG. 9 is a flowchart illustrating a procedure for using a customer encoder pattern or grating on the CD-R recordable media to print onto such media in accordance with the third embodiment of the present invention.

Once the scale factor 864 is computed, it is used in a self-resetting period counter 870 to count down the number of signals per angular position 140. When the count reaches zero, the next rotationally sequenced angular position has been reached, and a signal equivalent to the encoder pulse FIG. 9, 912, is generated. The radial print synchronizing system 204 generates the angular position pulse 140 by counting angular position pulses 884 and then resetting the count with rotation index pulses 862, which is functionally equivalent to the zero mark synchronization pulse signals 914 in FIG. 9. It is important to note that many of the processing operations and conditioning operations (as discussed later) between CD-R Recording Device 810 and Radial Print Synchronizing System 204 may be performed in any hardware/software within radial print system 200, such as in angular position processing unit 203.

An alternative embodiment may be configured to retrieve angular position 140 from an encoder pattern manufactured into the CD-R disc media for a radial printing system. This is an example of a fixed system. Referring to FIG. 9, portions of FIG. 1 are shown under a logic diagram, illustrating the placement of an optical encoder 130 over an encoder pattern on the inner hub 110. The encoded pattern 110 on the disc 100 contains two signal streams: higher-resolution pulses 912 counted by an encoder pulse counter 920 and secondly, a synchronizing zero pulse signal 914 produced by detecting the fixed physical encoded mark 910, which is tested by the zero mark logic 930 to determine when one rotation has occurred. If so, the Reset Counter 950 resets the Encoder Pulse Counter 920 to zero, to begin the start of the rotation count again. Where the logic test 930 result is "No" 934, a numeric value equivalent to the angular position 140 is yielded. This in turn is used by the Radial Print System 200 directly to synchronize and coordinate print head and pen firing order 660 on the spinning disc 100. Blocks 920, 930 and 950 are functionally equivalent to and are contained within block 204.

Extrapolation or Translation Measurement Techniques

In another embodiment of the present invention, a device may be configured to translate the angular position information from a pulse-train frequency source that is natively unsuitable for direct use in radial printing, i.e., either too low or too high. For example, the pulse train frequency source may be from the Hall Effects sensors of the spindle motor poles, or they may be from a low-resolution codewheel and encoder, or from a high-precision diffraction grating and encoder. Such translation mechanisms may be in the form of electronic frequency dividers (e.g., counters) or phase lock loops (e.g., frequency multipliers), depending on nature of the source or measurement signals, which represent techniques for the direct conversion of frequency (e.g., speed measurements).

By empirical observation, the ability of the rotating disc to instantaneously change rotational speed (and therefore its predicted/actual position by mathematical integration) is limited due to the rotational inertia possessed by the spindle system (mass) and the limit of magnitude of any external rotational forces (torques both positive and negative) that can be applied to the system. It is another empirical observation that once a disc system is rotating, the instantaneous changes in rotational speed e.g. wow and flutter are relatively small for the time period of interest for radial printing. However, it is critical for radial printing that wow which are slower changes in rotation speed and flutter which are more instantaneous changes in rotation speed, are accurately measured and tracked which is a fundamental purpose of any embodiment described in the present invention. Given these observations, the limits and boundaries of these operating parameters will now be more fully detailed illustrating methods used to determine or measure the maximum number of measurement events needed in order to fully characterize the physical rotational system and extrapolate or translate these measurements into the required number of angular positions needed for a radial print engine.

It is well known by those in the art that constant RPM rotational systems exhibit wow and flutter effects, which are modulations or changes to the constant speed. Closed-loop motor control systems of all types essentially make periodic measurements of speed and apply periodic corrective torque to the motor. This sequence of events causes the motor to speed up and then over time, due to frictional inertia, slow down, during repeated rotation. The long-term speed up and slow down is known as wow. In comparison, flutter involves instantaneous speed changes which are of shorter duration, and are localized events usually as a result of slip or grab in the bearings and mechanical systems or by sharp application of torque pulses from the motor, etc. The frequencies exhibited by wow are inversely proportional to the mass of the rotating system. Indeed, the wow of a large industrial motor is less than a hertz. Systems of the size of record player turntable exhibit wow from a few hertz to a few tens of hertz. Considering the low mass of a CD/DVD system one can expect wow and flutter in the few tens of hertz.

By empirical and experimental observation to minimize distortion and to optimize printing results, the present invention uses a convenient rotation speed approximately 500 RPM or less for radial printing. A CD drive also spins at 500RPM, the controlled speed at approximately the 2× rotation speed setting. While optimal printing speeds may be slower, 500 RPM is an available speed native to the drive's spindle motor system. As an experiment, using a 5000 line physical grating of the encoder spinning substantially constant at 500 RPM produces a raw pulse train at approximately 40 kHz (encoder channels A or B output). A spectrum analysis of this signal shows a fundamental spectral line at approximately 8.3 Hz, which is also the rotational speed (e.g., 8.3 rotations per second.) Having the fundamental at the rotational frequency indicates that the greatest instantaneous change in rotational speed happens once per revolution. Indeed, this is confirmed by the motor control electronics providing correction torque once per revolution. Harmonics, which contain all wow and flutter information, are 40 db lower than the fundamental at 100 Hz with some residual spectra out to 150 Hz. There are no spectra after 150 Hz. If an analog waveform having frequency components no higher than 150 Hz is digitized then via Nyquist's Theorem, a minimum of 2×150=300 samples per second are required to adequately capture all the existing information, i.e. to characterize the rotational system. Clearly a carrier of 40 kHz or samples/second is well over (over 100 times over sampling) the minimum necessary for an adequate capture or characterization. Having such a dense or fine grating produces a superior signal-to-noise ratio and clearly resolves all such low frequency changes (150 Hz or less); however, substantially no new speed or positional information is yielded above the theoretical minimum sampling rate of 300 Hz. Thus the higher cost of for such a precision encoder system is less warranted. However, higher sampling rates than the minimum are very desirable in order to yield better signal to noise ratios. This is experimentally confirmed when testing with a lower-count, 408 lines-per-rotation grating, which at 500 RPM produces a 3 kHz pulse stream. Such a grating or codewheel more than adequately resolves or recovers all the spectra characterizing the rotational system and yields a valid radial printing encoder pulse stream 110 130 912.

In contrast to frequency domain results described above, similar investigations in the time domain further support the minimal necessary pulses per revolution needed to characterize the encoder and or detection system to yield a valid radial printing pulse stream. Experimentally, a frequency modulating (FM) discriminator was built with center frequency at 40 kHz and used with the 5000 line grating encoder system. This device will accurately demodulate any frequency deviations (i.e., speed changes as detected by the precision encoder system) from the 40 kHz carrier. The discriminator may be set to different capture bandwidths. This is similar to using a tunable filter, allowing one to resolve structure in the detected amplitude vs. time waveform. Specifically, the instantaneous amplitude of the detected time-domain waveform represents the instantaneous frequency of the carrier (e.g., rotational speed) at any instant of time in the rotation (e.g., position). The observed waveform is monotonic and periodic, and shows clearly the wow and flutter of the rotational system. Since it is already known experimentally that there are practically no frequency components above a couple of hundred hertz, it is sufficient to set a 1 kHz bandwidth for the discriminator, knowing that there is substantially no structure or events occurring faster than this bandwidth limit. The detected waveform has a very high signal-to-noise ratio, and all structure seen are relatively slow compared with the 1 kHz sampling granularity of the discriminator's 1 kHz RC time constant. Clearly observed experimentally is the periodic 8.3 Hz=120 ms wow, which is the speed up and slow down per rotation of the CD spinning platter mechanism spinning at 500 rpm. Seen also are 40 ms (25 Hz) structure as well as 80 ms structure. With the discriminator set to lower bandwidths (e.g., approximately 800 Hz and 250 Hz) we still see the above-mentioned structure still clearly resolved.

Investigations via looking at the frequency spectra and time domain waveform of the precision encoder show that changes in rotational speed are represented by significant spectral components of the order of 100 Hz and less, or via time domain, that any speed change in the rotational system takes 10 ms or more to occur. All spectral components are found to be below 150 Hz fixing the fact that rotational speed changes need to take approximately 7 ms or more to occur. Therefore theoretically, speed or positional measurements taken significantly more often than this, yields substantially no more new information. In reality and by observation, however, to improve signal-to-noise ratios, stability and ultimately print quality, rotational measurement updates are made more often than this.

Figure 11:
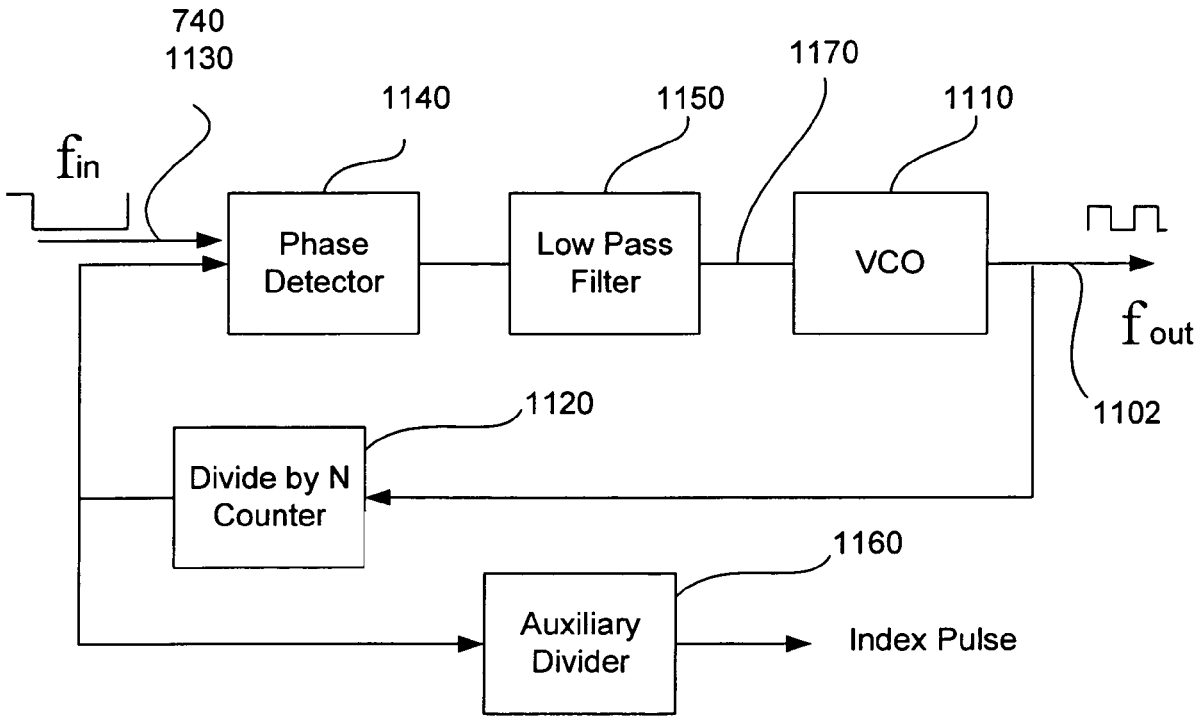
FIG. 11 is a diagrammatic representation of a classical digital PLL (DPLL) according to various embodiments of the present invention.

In an exemplary configuration, a phase lock loop (PPL), well know by those in the art, may be configured to translate the above described measurement events to be used for radial printing. The PLL is a system and device that lends itself superbly well in a number of cases as a solution to providing the higher number of pen firing pulses or angular position pulses 884 needed with respect to the fewer such as signal 818, 912 measurement event pulses available. As an accurate frequency multiplier or extrapolator, the PLL provides the extrapolated number of pulses needed between each slower measurement event that are frequency and phase coherent. A stable PLL system can provide on the order of 1000 extrapolated pulses for each input pulse. Referring to FIG. 11, the classical digital PLL (DPLL) well known in the art, may be described as follows: The voltage-controlled oscillator (VCO) 1110 produces the desired output multiplied-up frequency fout 1102. A divide-by-N counter 1120 divides this output frequency, which has a divide ratio of N where N is the output frequency divided by the PLL input frequency (i.e., the multiplied-up ratio). The PLL input frequency fin 1130 for radial printing system purposes is the encoder signal 740 (or 818) for example. Input frequency fin 1130 is then compared with the output of the divide by N counter 1120 in a phase detector block 1140, which develops an error signal dependent on the direction and magnitude of the phase error between the compared frequencies. The error signal is low-pass filtered 1150 to remove high frequency transient components and is applied to the VCO 1110 control signal to correct its frequency. To keep the output frequency 1102 in phase with the input frequency 1130, the error or control voltage continuously adjusts the output frequency. When in a properly locked condition, the output frequency 1102 accurately tracks the input frequency 1130 or any changes to the input (reference). Correct design dictates that the low-pass filter cut-off frequency be on the order of 10 times lower than the input or reference frequency. Therefore, the PLL generates a set of extrapolated output pulses (the pen firing signal) that are frequency and phase coherent to the slower set of input or reference signal, such as the radial printing drive spindle motor poles or encoder signal 740. The PLL IC for radial printing may be in the form of one of several of the integrated circuit family, CD4046 PLL, 74HC/HCT4046A or 7046A (available from Texas Instruments, Dallas, Tex.). For radial print applications, the PLL input Fin 1130 may be connected to signal 818 for example where rotary index period pulses are used as the rotation speed dependent source signals. In the case where code wheel grating patterns 110 and encoders 130 are used as the speed dependent source signals, then PLL input Fin 1130 may be connected to the encoder output signal 740 (or 912 if a course grating is used yielding too low a frequency output). The PLL's output signal Fout 1102 is functionally equivalent to signals 884 (or 912 if produced by a high count grating producing a sufficiently high frequency output). In a relative system design, the fixed physical mark 910 for example is not used to establish the synchronizing zero pulse signal 914 or the functionally equivalent rotation index pulse 862. These signals 914 or 862 are equivalent to the index pulses 1640 or 1720 and are synthesized by using the auxiliary divider 1160 in FIG. 11.

Included in FIG. 11 is the Auxiliary Divider 1160 which is used to create the index pulse 1640 1740. The divide value M for the auxiliary divider is equal to the number of pulses per rotation produced by the encoder system. For example, if the rotary index period 818 is the source signal, and it is structured such that there are 18pulses per rotation, then M=18. If an encoder pattern 110 for example is structured such that there are 408 pulses produced per rotation then M=408. Where a wobble or data-code 340/410 or other cd drive sourced signal is speed dependent it may be used as the source signal for the PLL Fin 1130, which may produce (y) pulses per rotation, then M=(y). The product of M and N is the number of counts per rotation produced as may be required by the radial print pen firing system. Alternately the number of counts per revolution is the quotient of Fout divided by the Index Pulse frequency. Next will be explained several PLL implementation examples in more detail.

Motor Control Pulses from the CD Drive as the PLL Reference Input

A desired goal is to reduce the cost of a radial printing system by using a lower-cost encoder and codewheel system. One approach may be to avoid using an additional external codewheel and encoder by instead using the motor speed detection pulses native to the CD spindle motor control system. One embodiment of this present invention may be configured to control the pen firing for radial printing by using a configuration with a PLL to generate the needed high number of pen firing pulses per rotation. The CD drive's motor servo system uses a number of Hall Effect sensors fixed in the circumference of the spindle motor, which produce a digital pulse when a motor pole sweeps across each, sequentially and respectively. Therefore the instantaneous frequency of the pulse train produced by the Hall Effect sensors directly represents the instantaneous motor (and CD) rotation speed. By way of example, in a typical drive, the summed Hall Effect sensors produce 18 pulses per rotation at the motor control IC's 3× pin designation output, such as with a Rohm BD6670 or similar IC. A further limitation is that some drives have spindle motor controllers with only six pulses per rotation available at the IC's 1× pin designation output pin. To obtain needed speed information update measurements per rotation, when comparing the limited pulse stream of just 18 or fewer pulses per rotation, with just one measurement event every 20 degrees of rotation, versus the precision 5000 count grating encoder, which provided a measurement event every 0.072 degrees, a challenge exists to obtain a reliably good radial print image, given this low number of measurement update pulses per rotation. However, such a low number of measurement updates per rotation may be used for radial printing since only very low frequency spectral components are involved in characterizing the rotation.

At 500 RPM, the 3× output of the motor control chip produces a very stable near 50% duty cycle periodic 150 Hz pulse train. Indeed, at this RPM, the rotational period is 120 ms and with 18 measurements per rotation, we see that they occur every approximately 6.7 ms, often enough to capture all possible speed changes in the rotational system as discussed above. With this 150 Hz signal as the reference frequency input to the PLL, and a value of N=1024 for the N divider in the PLL, an output frequency of approximately 153.6 kHz was obtained, (150 pulses/sec×N), which is a pen firing pulse rate of 18,432 pulses/rotation (18×1024=18,432). An auxiliary divider 1160 (FIG. 11) connected to the PLL phase comparison input 1140 with a divide ratio of 18 produced the required index pulse output (one pulse per rotation). It is noted that this index pulse is arbitrary since it is derived from the pulse stream, but it accurately represents some physical fixed position on the disc. This is possible since an arbitrary point is no more or less significant than a designated point. The fact that it is fixed and repeatable is what is significant. By observation, the radial print system printing on CD media may require a pen firing pulse rates range from 3,000 to 20,000 or more pulses per rotation, depending on the desired annular print density.

Figure 12A:
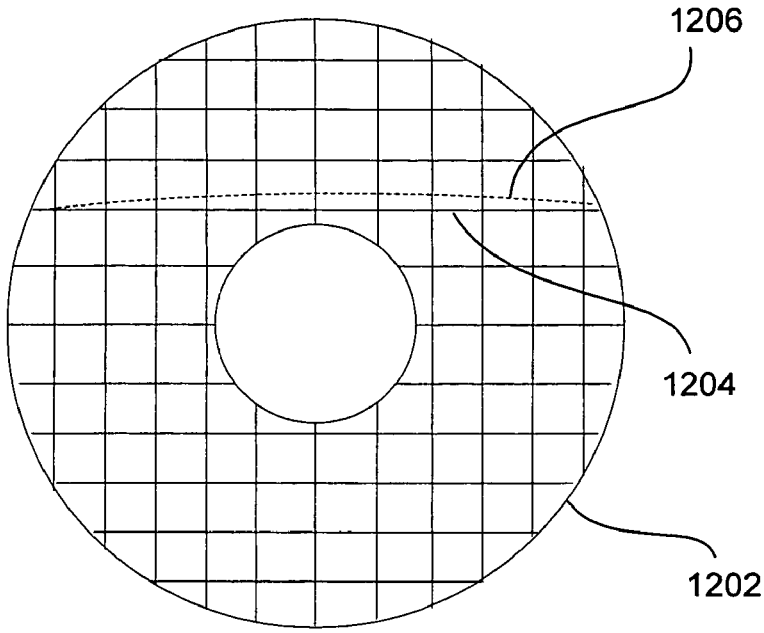
FIG. 12*a* is a diagrammatic representation of a grid test pattern according to various embodiments of the present invention.
Figure 12B:
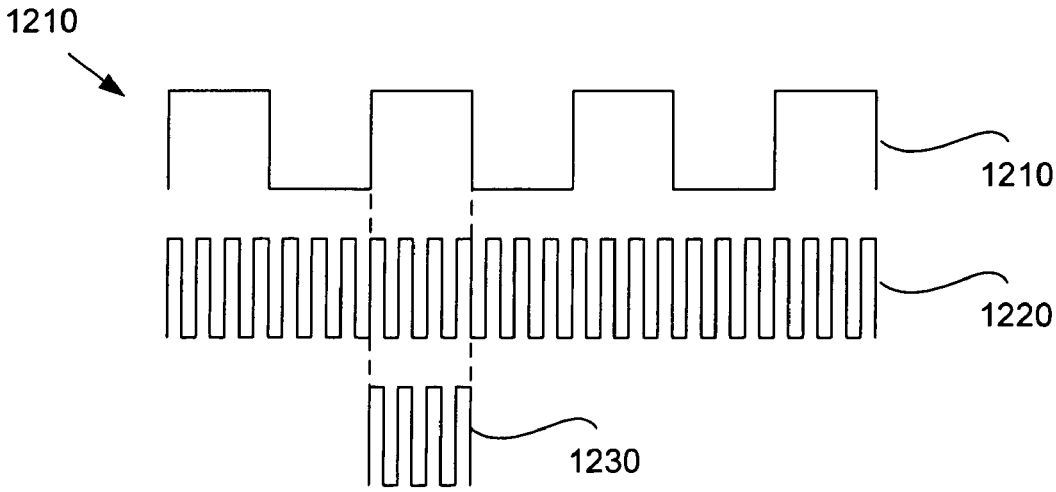
FIG. 12*b* is a diagrammatic representation of a Synthesized Multiplier Method according to various embodiments of the present invention.
Figure 13:
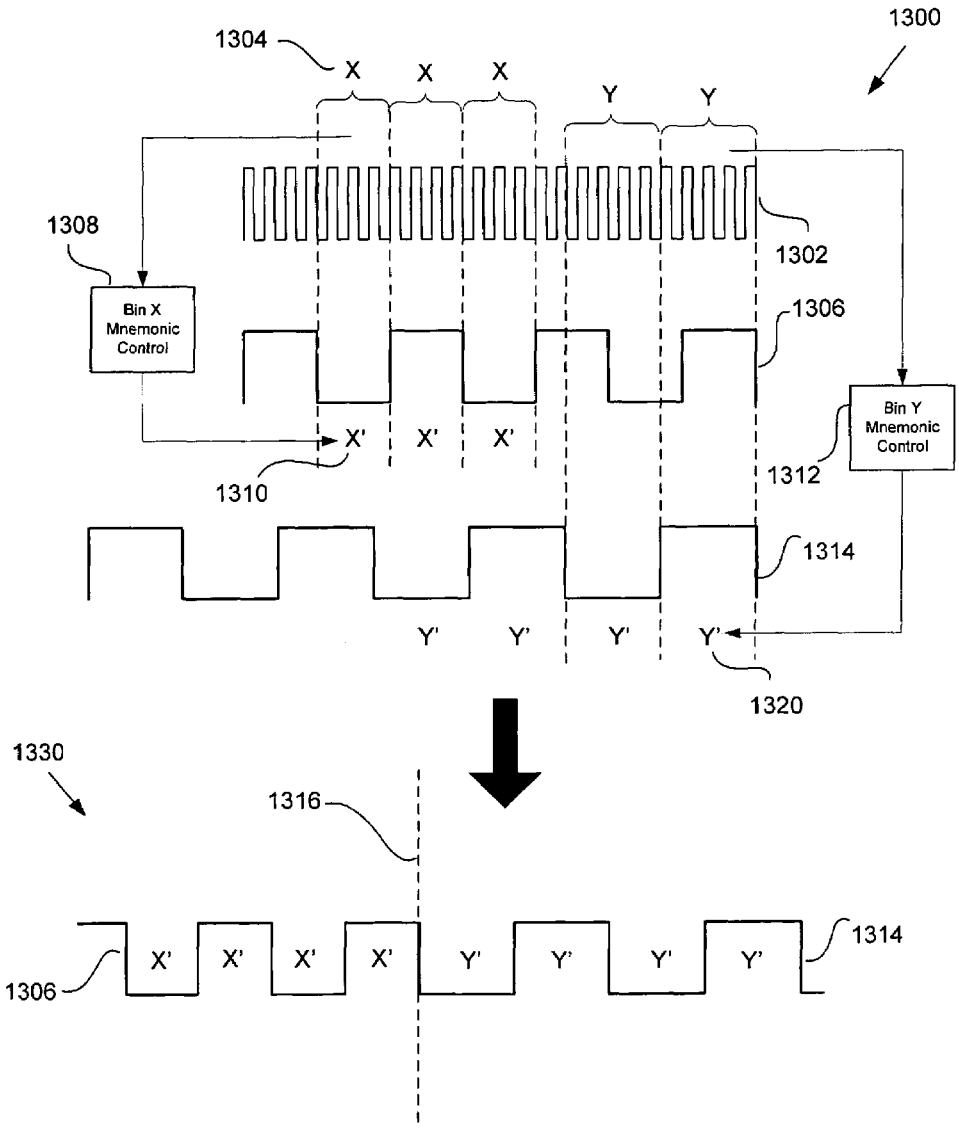
FIG. 13 is a diagrammatic representation of a Synthesized Multiplier Method that incorporates memory locations called "bins" according to various embodiments of the present invention.

Experimental results yield satisfactory results in printed output by a radial printer using a CD drive spindle motor with motor pole sensors and this PLL method. Close examination of the radial printer's output using a grid test pattern (see FIG. 12*a*, 1204) revealed that the grid lines were not as straight as those produced by the precision encoder as the reference standard 1204. The resultant PLL's grid lines were slightly curved or bowed 1206. The PLL used was the IC cd4046, with the bandwidth of the analog filter set very low (or the order of 25 Hz). Tuning the PLL for higher bandwidths generally gave various improvements but the system differed from the precision encoder's results due to the fact that the capturing of the full 100-150 Hz bandwidth was limited. The reason is that the PLL's filter cut off bandwidth has to be some reasonable factor (ideally 10) less than the reference frequency of 150 Hz at 500 RPM. Therefore, to recover the full bandwidth in this example, the disc would have to spin faster in order to increase the encoder signal frequency. However, a 500-RPM spindle motor speed may be one upper limit of rotation speed due to ink delivery and distortion issues disclosed by Bradshaw et al. However, approximately 50 Hz of bandwidth may be captured and can track any speed changes sufficiently for acceptable printed output, since the majority of spectral energy is present within this bandwidth. This observation with a 3× signal proves that the important speed changes are present within the first few harmonics of the 8.3 Hz fundamental. By comparison, a 1× signal produced a reference frequency of 50 Hz, one third lower. Using filters with bandwidths on the order of 10 Hz similarly yields satisfactory test printed outputs also with little observable grid line curvature 1206. Higher harmonics (higher frequency components) are necessary to reduce wow and thus straighten up the test grid lines 1204. The ability to capture these higher frequency harmonics results in a better instant-to-instant tracking as opposed to only tracking the slower averaged components of motion. Since these spectral components contain the instantaneous positional or speed information, an accurate capture and utilization of these harmonics is necessary. It is evident that the slight bowing or curvature 1206 to the printed test grid lines can be ascribed to the differences in the spectral line amplitudes when looking at the output of the precision vs. the PLL. The lines of course are identical in frequency values, but the amplitudes of the harmonics near 50 Hz, 100 Hz (and sub-multiples at 25 Hz, 75 Hz and 125 Hz for example) are skewed in the PLL output due to an unwanted applied bias. This is because energy from the too close 150 Hz carrier, sampling or reference input frequency has spilled over and thus contaminated these spectral lines, attributing to them greater amplitudes than what they should have. An axiom for using a PLL is that the input frequency Fin 1130 be 10 times higher than the bandwidth you are seeking to capture. Very sharp $5^{th}$ order and $10^{th}$ order filters were experimentally used to increase the isolation between the spectral components and the carrier and thereby prevent spill over.

When using an analog-digital PLL (DPLL), a configuration should adhere to the rule of having the filter cut-off frequency be of the order of 10 times lower than the carrier or input frequency. In this case the input frequency needs to be increased to an order of 1.5 kHz or more. Therefore for our analog-filtered PLL, a desirable way to get this higher input frequency is to increase the number of counts per rotation at a given rpm, by using an inexpensive codewheel or grating in lieu of having specialty spindle motors made having more Hall sensors. An important principle of this analysis is that if the analog PLL system did not have this restriction of seeking a factor 10 times the bandwidth equal to the reference frequency, and could recover all of the 150 Hz bandwidth, then the radial test print output grid pattern should yield totally straight lines 1204. Given this case, the 18 measurements per rotation (i.e., every 20 degrees of rotation) would be adequate for radial printing. In using an all-digital PLL (ADPLL) such as the TI 741s297, the above noted restriction with analog filters (DPLL) does not apply, so potentially greater recovered bandwidths are yielded.

Pre-Processing of Source or PLL Reference Signal

In an alternate embodiment, the angular position information 140 stream may be configured using the 1× or 3× motor control pulses or a low-precision codewheel such that the output signal and is pre-processed before conditioning by a PLL. Pre-processing of the source signal consists of first multiplying the source signal frequency up using non-PLL techniques, so that the source signal injected into the PLL is at higher frequency by some small factor, such as two or four times. For example one method for a configuration using the motor pole Hall Effect signals, the 150 Hz signal can be multiplied by 2 to 300 Hz by detecting the rising and falling transitions of the 150 Hz signal thereby doubling the number of measurement events, by using two monostables which are edge detection devices and then XOR'ing their outputs to get twice the frequency. In another configuration, circuits to detect edge transitions and to program appropriate delays may be used to construct the doubled frequency output. Encoder signal outputs, such as for use with codewheels, may have quadrature outputs, which when XOR'ed yield a frequency two times that of either of the two input channels; or when the quadrature outputs each combined with both positive and negative edge detection, signals which are four times the frequency of either of the two input channels are constructed. Alternatively, any other such pre-processing may be used to synthesize or extrapolate to higher frequencies before injection into the PLL. Improved print results may be achieved using techniques, such as just described, that allow recovery of a wider bandwidth as afforded by pre-processing the motor control signal. Such preprocessing is applicable to any source or input signal 1130 prior to conditioning by a PLL. Other PLL types, such as the All Digital PLL (ADPPL) like the TI 741s297 PLL, also may be used with the angular position information pulse stream with or without pre-conditioning.

Other techniques or implementations for obtaining higher frequency motor control pulses may be as follows: Setting up more Hall sensors in the circumference of the motor and having a combined output from summing each individual Hall sensor signal. In typical CD drives with 18 pulses for each rotation of the spindle motor shaft (the 3× signal), one configuration could improve performance by increasing the number of pulses per rotation by doubling or tripling or more for example, the number of Hall sensors installed in the spindle motor, at respectively decreasing angular spacing. Careful positioning at manufacture to insure that each Hall element is equidistant from its neighbor will insure a best possible desired 50% output duty cycle waveform. Such may be necessary if radial printing is done at significantly lower speeds than 500 RPM, since at lower spin-rate speeds the rotational inertia is lower with an inherently less stable drive platform, resulting in more wow and flutter errors. In this case far more measurements than once every 20degrees are necessary to adequately track rotation speed changes.

Another embodiment of the present invention may use a method of the above that would increase the output frequency of the encoder or motor pole—Hall sensor source. The method is similar to that of an optical grating technique, where a second physical set of Hall Effect sensors in a concentric ring, identical to the first set, is configured such that it is affixed at a 90-degree rotational offset, such that the 2concentric rings of sensors are physically offset with respect to each other by 90degrees. The second ring of sensors thus produces an output frequency identical to the first ring but at 90 degrees out of phase creating a quadrature signal with respect to the first. The two resultant pulse streams may be combined electronically in quadrature to yield a 2× and or a 4× frequency output.

Synthesized Multiplier Methods SMM

Yet another embodiment of the present invention may be configured to use a synthesized multiplier method or "SMM" as abbreviated and used herein. In this configuration for detection 1200, the encoder's square wave signal 1210 is used to open and close a gate passing a high speed clock signal 1220 to a counter. The number of pulses that the counter counts 1230 is directly proportional to the signal pulse width, hence its instantaneous frequency. The number of pulses 'captured' within each pulse width of the incoming pulse train represents information relating to the instantaneous frequency and frequency changes of the incoming pulse train, which again is directly related to instantaneous motor speed and disc position. This information may be directly operated on or may be coded as mnemonics 1308 which may be used to synthesize or control a pulse train at some desired output frequency. Real-time processing may be needed to create a synthesized pulse train whose frequency changes are constructed directly from this captured information. Even though this method may be useful in the preprocessing block, it may also be used to replace the PLL, again where mnemonics representing encoder information 1310, 1320 are used to control a synthesized pulse train, which then is the pen-firing signal.

The several embodiments and methods described above are applicable to any type of physical detection mechanism. In other words any detection mechanism may be used to obtain the angular position necessary for radial printing. For example, the detection system may be configured to use magnetic means as in the case of motor poles brushing past Hall sensors, or it could be an optical detection mechanism where light is passed through or reflected from an optical grating to produces signals that contain information on rotation speed or position. To clarify, having more Hall sensors positioned closer together in the spindle motor's stator is equivalent to having a finer optical grating, all of which equates to having more updating or detection events occur per rotation. Having two rings of Hall sensors positioned in quadrature is the same as having two optical sensors positioned in quadrature thereby generating two pulse streams 90 degrees out of phase with respect to each other.

Synthesized Multiplier Methods

Synthesized Multiplier Methods ("SMM" as used herein) may be used in an embodiment of the present invention to represent indirect frequency multiplication or translation methods. In general, such methods and techniques digitally capture the measurement information and in turn, using different mathematical or algorithmic procedures, operate on the captured measurement information and process it. For example, a radial printing system may be configured to use methods to convert and translate the annular measurement information to other operators that control a fast clock to create or synthesize representative high frequency signals (e.g., multiplication), which in turn yields the required pen timing signals providing the required number of pulses or counts per disc rotation for use in radial printing. These conversion techniques, whether direct or indirect, are not restricted to linear mappings, such as input frequency to output frequency. Various interpolations may be preformed, linear or otherwise, to tailor the printhead pen firing timing signal either for general radial print quality improvements, or for corrections due to various biases, interference patterns, etc.

The Synthesized Multiplier Method (SMM) will now be explained in more detail. As has been previously described, the varying pulse widths of the encoder signal represent instantaneous frequency changes, therefore CD disc speed and positional changes. Quantifying each pulse width in the encoder train can easily be done as discussed. Using the rising edge of a pulse to open a gate and its falling edge to close the gate which passes a stream of high speed system clock signals is a simple detection method which relates the pulse width to the number of clock pulses counted. Each detection count is assigned a "bin" which is a memory location. The number of bins determines the control or resolution of the output frequency synthesizer. The number of bins is equal to the number of measurement events per rotation. One may note that the accuracy of determining a pulse width will be +/−2 clock counts 1302 (one when the gate opens and one when it closes), the degree of accuracy as a percentage of total counts per width is determined simply by the choice of clock frequency 1302, where the higher frequency may yield more accurate measurements. A reasonable limit at which accuracy no more serves the precision of the measurement is determined by "noise" and "flutter," inherent as instabilities of the rotational system. By way of example, there are uncertainties in the motor pole system, of actually when the Hall Effect sensor fires and releases, thus introducing uncertainty or jitter into the system. Each pulse width therefore will tend to have some random error associated with it.

SMM—General

In one embodiment of the present invention, a first approach (SMM1) uses no averaging, is done in real time meaning that there is essentially no delay from input to output signals and can use simple filtering or processing, such as smoothing. Memory locations called "bins" are constructed. Each bin is assigned an upper 1404 bound and lower 1402 bound for the detected count value 1304. The size of each bin is determined by the difference between its upper and lower bound. Each detected count value will therefore find itself a bin. Each bin 1400 has an associated mnemonic 1308 or code or value assignment which when mathematically operated on produces control data 1310, which is used to control a high frequency clock (either the same one 1302 or other equivalent) to synthesize the correct output pen-firing signal. Specifically: f(x)=x'. Here x' 1310 is the mnemonic or code associated with value x 1304 within bin x. When operated on 1308, the result is x' 1310 which is a value associated with the control data which controls the high speed clock 1302 producing the generated or synthesized output frequency 1306. Similarly, f(y)=y' where y' is the mnemonic associated with bin y. When bin y is operated on 1312, the result is y'1320 which is associated with the control data that produces the output frequency 1314. Again, a fast clock (synchronous) 1302 is used as the basis for constructing or synthesizing the output (pen) signal. Each mnemonic instructs/determines how many of these fast clock pulses should be assigned "high" (with an equivalent number for "low" to produce a 50% duty cycle). In other words, each mnemonic 1308, 1312 is associated with a different frequency 1306 1314. The more the bins, the more discrete frequencies are synthesized. For the duration of time that any one bin is active, it is its associated frequency that is produced 1306, which is a continuous pulse train of the same-sized highs and lows which is at a specific frequency. Only one bin may be active at any one time. When another bin and its associated mnemonic and control data become active, there is a step function change 1310 to a new discrete frequency 1314. This new bin and mnemonic represents new information determining a new number of how many fast clock pulses stay high and equivalently low. Each bin stays active for one cycle or period of input or encoder frequency. With this system, the output (pen) signal 1330 is composed of a stream of different discrete frequencies, whose frequency at any time is determined by the active bin. The transition event 1310 occurs when another bin becomes active.

SMM1—Detailed

Describing this approach above in more detail, for another embodiment of the present invention, the active bin is the one that is being currently filled or chosen; for example, by the detected count value that selected it. This approach may be similar or equivalent to the sample and hold method described above used in the analog PLL filter. The difference being that in the analog PLL system there is an RC time constant that smoothes the transition to a new frequency, where as in the simple SMM approach system there is no time constant smoothing the discrete transitions, not normally an issue if the discrete jumps are small. Where there is an issue with this approach is that exactly what is detected (and therefore its associated mnemonic) is what is generated in the output signal to the pen. So for example, if an excessive jitter, or noise such as a spike or some other anomalous effect occurs for some particular period of the encoder input, then that anomaly is instead output. Thus instead of a completely orderly increment or decrement in bin numbers, the result is bin numbers jumping randomly or haphazardly among positions, even though following a general trend of increasing or decreasing frequency. The orderly increase and decrease in bin numbers may be well obscured even though present due to monotonic trend. In other words, the regular monotonically increasing or decreasing frequency changes which accurately characterize the rotation pattern can be sharply broken due to noise or other measurement anomalies.

[SMM1*a*]

Figure 14:
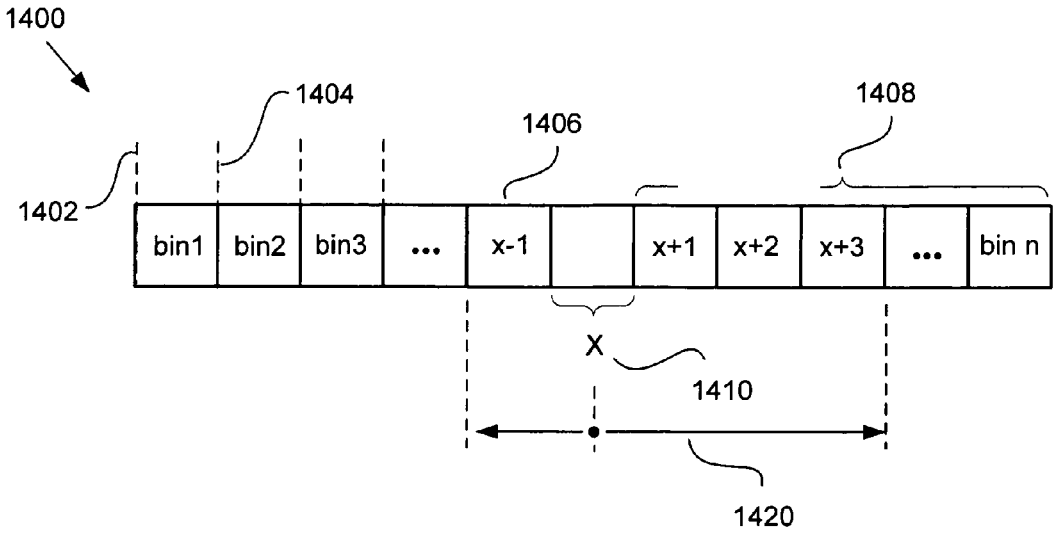
FIG. 14 is a diagrammatic representation of successive bin numbers according to various embodiments of the present invention.

For yet another embodiment of the present invention, some simple smoothing may be possible for the SMM1 system previously described in order to contour and force a more orderly behavior, such as with filtering. This alternative configuration will be called "SMM1*a*" as used herein. SMM1a is an extension of SMM1 with additional filtering or smoothing introduced. Filtering is based on introducing a software rule that "limits how far away" the next active bin can be compared to the current active bin. The rule defines and limits how many bins that may be skipped over to find the next active one. In other words, where noise spikes or other measurement anomalies may cause a "far away" bin number to become active, a rule may be set up limiting how far the excursion can be. In referring to FIG. 14 we see a representation of successive bin numbers 1400. We note that bin x 1410 is currently active. If all things were ideal, then with a monotonically changing waveform representing changing disc speed, we would expect upon the next detection and measurement pulse that the next bin x+1 would next become active, and after bin x+1has finished its active period, then bin x+2 would become active successively progressing to the last bin n in the rotation 1408. If however an anomaly or irregularity occurred due to a noise spike or jitter for example, then the detected count might select bin x+5 for example to become active rather than the expected bin x+1which is far way from the currently active bin x. If this happened, then the 'Simple Smoothing Maximum Excursion Rule 1420 may be invoked. The rule may be configured for this example such that the maximum excursions for selecting the next active bin are bin x−1 and bin x+3. Therefore, instead of the correct bin x+5becoming active, bin x+3 is made active. Similarly if the detected count selects bin x−2, then the rule makes bin x−1 active 1406 instead. Therefore irrespective of the correct bin to be filled or to become active as determined by the detection count, the rule forces the bin number at the limit of the allowed excursion to be used if the correct or selected bin is outside the boundaries of the rule. If the correct or selected bin is within the boundaries of the rule then it becomes active since the rule then is not invoked. The amount of filtering, soft to hard, therefore depends upon how far away active excursions are permitted. Hard filtering would be, for example, limiting the next active bin to be just a few bin numbers each side of the currently active bin. A more advanced filter would detect the slope of the frequency trend, and then, say for increasing frequency, allow only one previous bin (a lower frequency) and one three succeeding bins to become active. Other such refinements may also be configured for use herein, such as prediction algorithms, which may be applied in order to better smooth the output frequency transitions. The inherent number of bins created determines the granularity of size of output frequency steps possible. The more the bins, the smaller they become as defined by their upper and lower bounds; thus when translated or converted 1308, 1312 in order to control the output pulse generator, the frequency transitions or steps become smaller. Other rules may be configured to govern the behavior of the generated output pulse train.

[SMM2: Pseudo Real Time Smoothing (via Sampling and Accumulation)]

Figure 15:
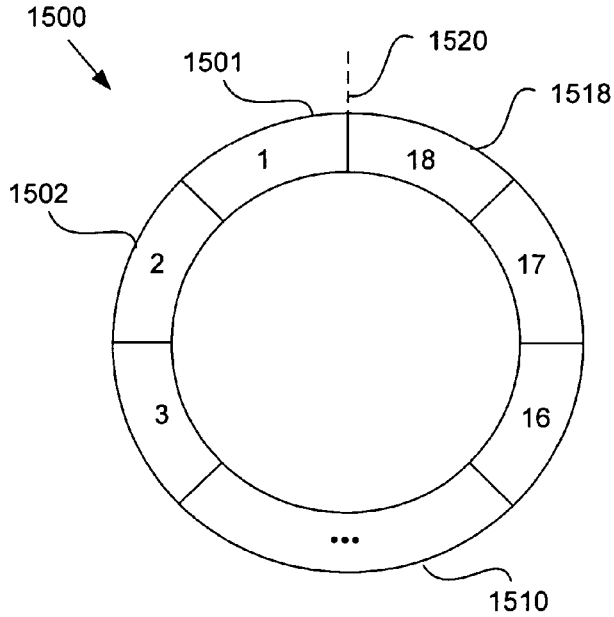
FIG. 15 is a diagrammatic representation of a Synthesized Multiplier Method that incorporates "slots" according to various embodiments of the present invention.

Another embodiment of the present invention, may be configured to use pseudo measurement-time smoothing via sampling and accumulation, and will be called "SMM2" as used herein. Each rotational system is in fact slightly different than its same manufactured-lot numbered sibling, and even more slightly different than its cousin from another lot. It would be desirable to characterize each drive's spindle motor individually. This can be done, since it is observed that the pattern of speed changes is constant and repetitive within each rotation and from rotation to rotation in each given drive. Identifying this pattern goes hand in hand with controlling the noise or random fluctuations. The following algorithm method is used for the SMM2 method:

(A) As per FIG. 15, one fills slots 1500 (memory locations) in sequence. Each slot has several memory locations associated with it. 18 slots are shown in FIG. 15, representing the 18 pulses per rotation of a motor pole signal source. (Slots are not the same as bins described previously because there is no upper or lower boundary on the detection count, which determines the bin filled.) The slot sequence starts from the index pulse 1520 1740. The first detection value is stored in slot 1 1501 with the next detection value stored in slot 2 1502 and so on 1510. So, for an 18 pulse per rotation system there are 18 slots filled in sequence. Similarly, there are 408 slots for a 408 grating encoder. The number of slots equals the number of pulses per rotation that the measurement system produces.

(B) One allows several rotations to occur at the steady state rotation speed. The first rotation fills memory location 1 in each of the 18 slots. (s1m1, s2m1, . . . s18m1). The next rotation (rotation #2) fills memory location 2 in each of the 18slots (s1m2, s2m2, . . . s18m2) and so on. With each succeeding rotation, new entries (detection counts) are accumulated or stored within the several memory locations associated with each slot. The final or actual value (and mnemonic) for each slot is the average of its several entries.

C) Several averaging or weighting schemes are possible, either with or without weighting. The simplest scheme would be the running average, where the number of entries to be averaged remains some fixed constant. For example if the constant was 5, then 5 rotations would have to go by. The 5 entries (for that slot) would be averaged, and the result would be the detection value (and mnemonic) for that slot. For the next or $6^{th}$ rotation, the first rotation's detected value entry would be discarded, the $6^{th}$'s rotation's detected value entered and the 5 values once again are averaged producing the new detection value for that slot. As soon as that averaging calculation is made, that detection values mnemonic is used to control the pen output generator. Each slot's detection value is mathematically operated upon (at the least, simply scaled by a constant) that will control or cause the synthesized output to produce the correct frequency (defined) for the time the slot is active. Thus the slot's newly averaged values (after being operated on—mnemonic) determine the actual output frequencies as the slots are stepped though in sequence. The number of slots determines the granularity or size of each frequency step-the fewer the number of slots, the larger the steps.

Greater averaging yields more filtering or noise reduction. Signal-to-noise or smoothing scales as the root of the number of averages made. Other averaging schemes may be alternatively possible, such as taking the current average value (detection value) and adding it to the newest or latest measurement detected value and dividing by two to create the new average detection value. Weighting coefficients to the two terms may be used in order to select more or less emphasis on past versus latest entries. Similarly, a more general case may apply a weighting coefficient to each term in the average.

[SMM3→SMM2 Plus Interpolation.]

Figure 16:
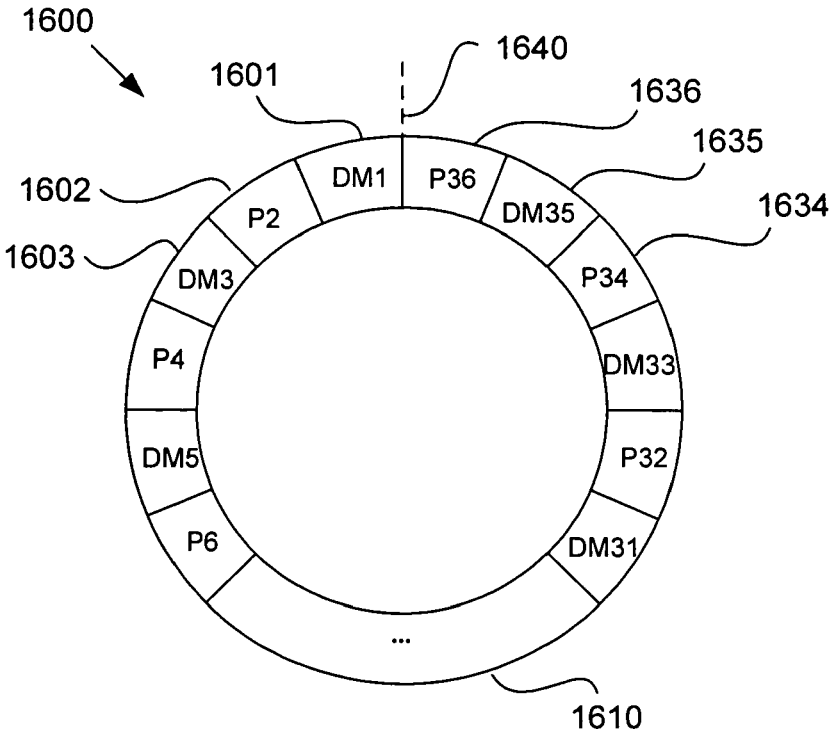
FIG. 16 is a diagrammatic representation of successive slots according to various embodiments of the present invention.

Another embodiment of the present invention, may be configured to use pseudo measurement-time smoothing via sampling and accumulation plus interpolation, and will be called "SMM3" as used herein. A radial printing system may be configured using motor poles and as such may have a number of measurement slots. For example, a typical CD drive spindle motor system produces 18 pulses per rotation. Each of these 18 pulses per rotation is a measurement event, with the results of each measurement or measurement value stored in each of the 18 successive slots. In FIG. 16, by way of definition, we will call each of these 18 slots 'detection-measurement (dm) slots because the pulse has been detected, measured and stored 1601 1603 1635. As previously described, the several memory locations within each slot are needed to store measurement values obtained in successive rotations of the spindle motor disc system. It may be determined that having only 18 dm slots is too restrictive, in the sense that there are only 18 discrete frequencies making up the output (pen) stream. This can be increased through interpolation by creating ever more pseudo slots 1602 1634 1636 or non-measurement slots. By way of definition, a pseudo slot has no detection or measurement events associated with it. It is a memory location whose data or value is not a measured value of an encoder pulse. The pseudo slot's value or data is constructed or derived by mathematically operating on the values in other slots (both dm and or pseudo). For example, where one pseudo slot 1602 is placed between 2 dm slots 1601 1603, the value of the pseudo slot would be the average of the values of the two adjacent dm slots. Any convenient number of one or more pseudo slots 1702 may be created and placed between dm slots 1701 1708. The benefit is that by increasing the total number of slots per rotation, dm plus pseudo slots, smaller step changes in frequency are produced. This greater number of total slots is used in generating the output stream which therefore will have finer granularity and thus overall better control of timing for radial printing.

For example, if the number of pseudo slots is made equal to the number of dm slots (FIG. 16) then the total number of slots is doubled. The pseudo slot is positioned between each measurement slot. The value entered into each pseudo slot is the weighted average of the final detection values found in each adjacent measurement slot. Normally the weighting ratio may be divided equally, usually where there is a linear increase or decrease in detection values in successive slots (e.g., constant rate of change of rotational speed). Alternatively, where the acceleration or deceleration of the disc system is not constant or may be changing sign, then the method may be to change the weighting coefficients and or simply create more interpolated pseudo slots, to achieve better smoothing and control of the output.

[SMM4: Fourth Approach SMM: Using 'Sigma-Delta' Techniques]

Figure 17:
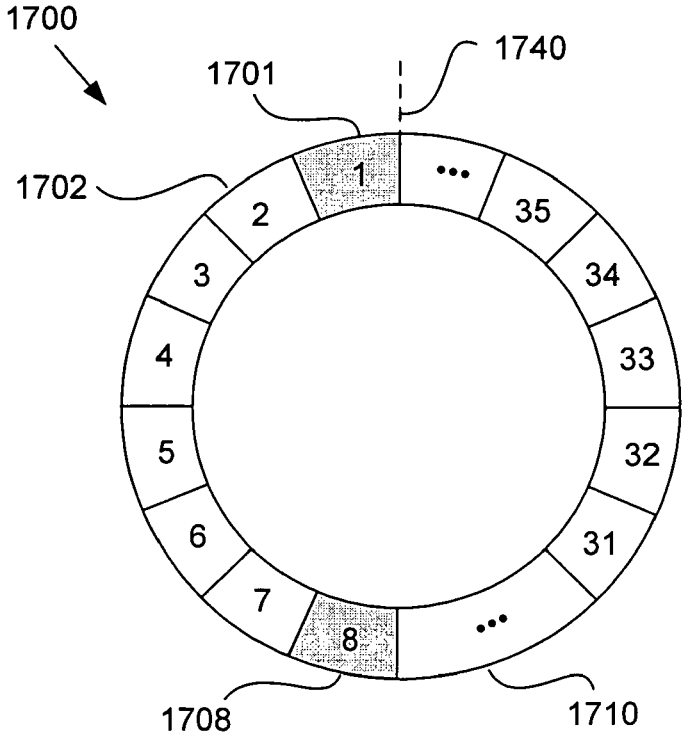
FIG. 17 is a diagrammatic representation of interpolation in creating ever more pseudo slots or non-measurement slots according to various embodiments of the present invention.

Yet another embodiment of the present invention may be configured to use Sigma-Delta techniques and will be called "SMM4" as used herein. In the digitization of analog waveforms, widely known in the art, codec's may use sigma-delta encoding methods. Essentially, a digital word which represents the amplitude value of the input waveform when sampled, and is subtracted from the previously sampled word. These differences are what are stored or remembered, and then are later used to reconstruct the waveform. In the present embodiment, this approach may be used as a variant of SMM3 method previously described, wherein values created for interpolated pseudo slots are obtained by operating on the differences between measurement slots. For example, FIG. 17 shows six pseudo slots 1702 numbered 2 to 7 and placed between dm slots numbered 1 1701 and 8 1708. Suppose that slot 8's detection value minus slot 1's detection value is D. Then D divided by (the number of interpolated pseudo slots plus 1) gives the increment value to be used. Therefore, pseudo slot 2 1702 detection value will be measurement slot 1 1701 detection value plus increment, and pseudo slot 3 detection value will be pseudo slot 2 plus increment, and so on.

In the example above, equal weighting may be given to each pseudo slots detection value using the same increment. This method is appropriate when the number of pseudo slots created is relatively small or if the rate of change in disc speed is constant between measurement slots. However, if many pseudo slots are to be created between measurement slots, then different weightings should be made for each increment used. Such weightings will assign more correct detection values to the pseudo slots reflecting actual speed changes. This is especially important where the sign of the slope of the speed changes between two far-apart measurement slots. Pseudo slots can be assigned values based on the calculated increment or may be modified depending on the acceleration or deceleration behavior of the speed changes. The objective is to tailor the detection values and associated mnemonics so as to follow or duplicate the waveform typified at a DPLL's VCO control line 1170 or other detector showing speed changes vs. time. Methods SMM2 to SMM4 as previously described above are based upon the fact that the behavior of the rotating system is consistent and repeatable, rotation after rotation. The rotational system's inertia together with applied torque via servo system control, defines monotonically increasing and decreasing speed changes, which are consistent and repeatable rotation after successive rotation. Experimental results have shown this to be the case. Where servo systems are not used to control the motor speed, we again observe consistent, repeatable patterns representing speed changes within each rotation and from rotation to rotation. Where this is the case, methods SMM1 to SMM4 may be applicable.

The exemplary concept and novel use of signal processing to determine angular position information for radial printing as defined in the present invention illustrate the overall principle and application of the more general solution for a highly integrated system for recording and label printing circular media in a single insertion of the media. While this invention has been described in terms of several preferred embodiments, there are alterations, permutations, and equivalents that are all within the scope of this invention. For example, these techniques equally apply to radial sled printing as disclosed in co-pending U.S. Provisional Patent Application No. 60/566,468, filed Apr. 28, 2004, which is hereby incorporated by reference. It is therefore intended that the following appended claims be interpreted as including all such alterations, permutation, and equivalents as they fall within the true spirit and scope of the present invention.

What is claimed is:

1. A method for radially printing onto a rotating media using a radial printing system, the method comprising:

receiving a pulse train frequency source signal that corresponds to the rotating media's speed;

determining whether conditioning of the pulse train frequency source signal is necessary by evaluating whether the flutter or wow characteristics of the pulse train frequency source signal cause the pulse train frequency source signal to be suitable for printing;

translating the pulse train frequency source signal when conditioning is necessary without affecting the rotating media's speed so that the pulse train frequency source signal is suitable for printing; and radially printing onto the rotating media using either the pulse train frequency source signal or the translated pulse train frequency source signal.

2. The method of claim 1, wherein the pulse train frequency source signal is selected from the group consisting of motor control signals, Hall Effect sensor signals, encoder signals, and timing signals.

3. The method of claim 1, wherein determining whether conditioning of the pulse train frequency source signal is necessary comprises:

measuring the pulse train frequency source signal for a number of sampling pulses, and comparing the number of sampling pulses to a set minimum of sampling pulses, wherein conditioning is necessary if the measured number of sampling pulses falls below the set minimum.

4. The method of claim 3, wherein translating the pulse train frequency source signal comprises:

increasing the measured number of sampling pulses to at least the set minimum of sampling pulses with a translation technique.

5. The method of claim 4, wherein the set minimum number of sampling pulses is equal to or greater than 300 samples per second (Hz).

6. The method of claim 4, wherein the translation technique is direct.

7. The method of claim 4, wherein the translation technique is indirect.

8. The method of claim 3, wherein translating the pulse train frequency source signal comprises:

pre-processing the pulse train frequency source signal.

9. The method of claim 1, wherein the translation technique comprises:

implementing a phase lock loop.

10. The method of claim 1, wherein the translation technique comprises:

implementing a synthesized multiplier method.

11. The method of claim 10, wherein the synthesized multiplier method comprises:

capturing a number of high speed clock pulses within each pulse of the pulse train frequency source signal;

assigning the number of high speed clock pulses into an allocated memory location, wherein the number of high speed clock pulses define a mnemonic value for the allocated memory location; and generating a pen firing control signal using the mnemonic value.

12. The method of claim 11, wherein the synthesized multiplier method further comprises:

inserting a pseudo memory location next to the allocated memory location; and assigning a weighted mnemonic value to the pseudo memory location, the weighted mnemonic value being calculated from the mnemonic value of the allocated memory location.

13. The method of claim 11, wherein the allocated memory location is either a bin or a slot.

14. The method of claim 1, wherein determining whether conditioning of the pulse train frequency source signal is necessary comprises:

measuring the pulse train frequency source signal for a number of sampling pulses, and comparing the number of sampling pulses to a set minimum of sampling pulses, wherein conditioning is necessary if the measured number of sampling pulses falls above the set minimum.

15. The method of claim 14, wherein translating the pulse train frequency source signal comprises:

decreasing the measured number of sampling pulses to at most the set minimum of sampling pulses with a translation technique.

16. The method of claim 15, wherein the set minimum number of sampling pulses is equal to or less than 40,000 samples per second (Hz).

17. The method of claim 15, wherein the translation technique is direct.

18. The method of claim 17, wherein the translation technique comprises:

implementing an electronic frequency divider.

19. The method of claim 15, wherein the translation technique is indirect.

20. The method of claim 19, wherein the translation technique comprises:

implementing a synthesized multiplier method.

21. The method of claim 20, wherein the synthesized multiplier method comprises:

capturing a number of high speed clock pulses within each pulse of the pulse train frequency source signal;

assigning the number of high speed clock pulses into an allocated memory location, wherein the number of high speed clock pulses define a mnemonic value for the allocated memory location; and generating a pen firing control signal using the mnemonic value.

22. The method of claim 21, wherein the synthesized multiplier method further comprises:

inserting a pseudo memory location next to the allocated memory location; and assigning a weighted mnemonic value to the pseudo memory location, the weighted mnemonic value being calculated from the mnemonic value of the allocated memory location.

23. The method of claim 21, wherein the allocated memory location is either a bin or a slot.

24. The method of claim 1, wherein radially printing comprises:

generating a rotation index pulse, the rotation index pulse being a zero synchronization mark; and synchronizing the rotation index pulse with either the pulse train frequency source signal or the translated pulse train frequency source signal in controlling a pen firing frequency for radially printing onto the rotating media.

25. The method of claim 24, wherein generating the rotation index pulse is from a fixed radial printing system.

26. The method of claim 24, wherein generating the rotation index pulse is from a relative radial printing system.

27. A radial printing system, comprising:

means for receiving a pulse train frequency source signal;

means for determining whether conditioning of the pulse train frequency source signal is necessary by evaluating whether the flutter or wow characteristics of the pulse train frequency source signal cause the pulse train frequency source signal to be suitable for printing;

means for translating the pulse train frequency source signal when conditioning is necessary without affecting the rotating media's speed so that the pulse train frequency source signal is suitable for printing; and means for radially printing onto the rotating media using either the pulse train frequency source signal or the translated pulse train frequency source signal.

28. An apparatus for recording and printing onto a rotating media comprising:

a recording device operable to rotate the media and to record data onto the rotating media, wherein the recording device is further operable to provide a pulse train frequency source signal comprising one or more pulses generated at predefined angular positions within each revolution of the rotating media; and a radial printing system operable to:

receive the pulse train frequency source signal;

determine whether conditioning of the pulse train frequency source signal is necessary by evaluating whether the flutter or wow characteristics of the pulse train frequency source signal cause the pulse train frequency source signal to be suitable for printing;

translate the pulse train frequency source signal when conditioning is necessary without affecting the rotating media's speed so that the pulse train frequency source signal is suitable for printing; and radially print onto the rotating media using either the pulse train frequency source signal or the translated pulse train frequency source signal.

29. An apparatus as recited in claim 28, wherein the radial printing system is further operable to:

generate a rotation index pulse, the rotation index pulse being a zero synchronization mark; and synchronize the rotation index pulse with either the pulse train frequency source signal or the translated pulse train frequency source signal in controlling a pen firing frequency for radially printing onto the rotating media.

30. An apparatus as recited in claim 28, wherein the radial printing system comprises a phase lock loop for performing the translation operation.

* * * * *